US005888316A

United States Patent [19]

Erickson

[11] Patent Number: 5,888,316

[45] Date of Patent: Mar. 30, 1999

[54] NICKEL-COBALT BASED ALLOYS

[75] Inventor: Gary L. Erickson, Muskegon, Mich.

[73] Assignee: SPS Technologies, Inc., Jenkintown, Pa.

[21] Appl. No.: 868,224

[22] Filed: Jun. 3, 1997

Related U.S. Application Data

[63] Continuation of Ser. No. 418,746, Apr. 7, 1995, Pat. No. 5,637,159, which is a continuation of Ser. No. 25,207, Mar. 2, 1993, Pat. No. 5,476,555, which is a continuation-in-part of Ser. No. 938,104, Aug. 31, 1992, abandoned.

[51] Int. Cl.[6] ..... C22C 19/05

[52] U.S. Cl. ..... 148/410; 148/428; 148/419; 148/442; 420/448; 420/588

[58] Field of Search ..... 148/404, 410, 148/428, 419, 442; 420/442, 448, 588

[56] References Cited

U.S. PATENT DOCUMENTS

| | | | |
|---|---|---|---|
| 3,061,426 | 10/1962 | Bieber | 420/448 |
| 3,300,347 | 1/1967 | Kasza et al. | 148/587 |
| 3,356,542 | 12/1967 | Smith . | |
| 3,385,698 | 5/1968 | MacFarlane et al. . | |
| 3,411,899 | 11/1968 | Richards et al. . | |
| 3,589,893 | 6/1971 | Lund et al. | 420/448 |
| 3,667,938 | 6/1972 | Boesch . | |
| 3,767,385 | 10/1973 | Slaney | 148/442 |
| 4,093,476 | 6/1978 | Boesch | 420/586 |
| 4,795,504 | 1/1989 | Slaney | 148/419 |
| 4,908,069 | 3/1990 | Doherty et al. | 148/419 |
| 4,931,255 | 6/1990 | Doherty et al. | 420/586 |
| 5,037,495 | 8/1991 | Henry | 148/410 |
| 5,156,808 | 10/1992 | Henry | 420/448 |
| 5,226,980 | 7/1993 | Tsukuta et al. | 148/419 |
| 5,370,497 | 12/1994 | Doi et al. | 420/448 |
| 5,476,555 | 12/1995 | Erickson | 148/410 |
| 5,637,159 | 6/1997 | Erickson | 148/410 |

FOREIGN PATENT DOCUMENTS

| | | |
|---|---|---|
| 0248757 | 12/1987 | European Pat. Off. . |
| 0442018 | 8/1991 | European Pat. Off. . |
| 135533 | 6/1974 | United Kingdom . |

OTHER PUBLICATIONS

"Phacomp Revisted" by H.J. Murphy, C.T. Sims and A.M. Beltran, vol. 1 International Symposium on Structural Stability in Superalloys (1968).

Which High Performance Material for High–Performance Fastening? by Thomas A. Roach, Materials Engineering, Jul. 1981, 5 pages.

"Aerospace High Performance Fasteners Resist Stress Corrosion Craching" by Thomas A. Roach, Materials Performace vol. 23, No. 9, pp. 42–45, Sep. 1984.

(List continued on next page.)

*Primary Examiner*—Margery Phipps
*Attorney, Agent, or Firm*—James D. Dee

[57] ABSTRACT

This invention relates to nickel-cobalt based alloys comprising the following elements in percent by weight: from about 0.002 to about 0.07 percent carbon, from about 0 to about 0.04 percent boron, from about 0 to about 2.5 percent columbium, from about 12 to about 19 percent chromium, from about 0 to about 6 percent molybdenum, from about 20 to about 35 percent cobalt, from about 0 to about 5 percent aluminum, from about 0 to about 5 percent titanium, from about 0 to about 6 percent tantalum, from about 0 to about 6 percent tungsten, from about 0 to about 2.5 percent vanadium, from about 0 to about 0.06 percent zirconium, and the balance nickel plus incidental impurities, the alloys having a phasial stability number $N_{v3B}$ less than about 2.60. Furthermore, the alloys have at least one element selected from the group consisting of aluminum, titanium, columbium, tantalum and vanadium. Also, the alloys have at least one element selected from the group consisting of tantalum and tungsten. Articles for use at elevated temperatures, such as fasteners, can be suitably made from the alloys of this invention.

17 Claims, 6 Drawing Sheets

400X

OTHER PUBLICATIONS

"Mechanical Properties of a New Higher Temperature Multiphase ® Superalloy", by Hagan et al. Superalloys 1984, Conf. Proc. Metallurgical Soc of AIME Oct. 7–11, 1984 pp. 621–630.

Rene 95 Alloy Specificator, Alloy Digest , Filing Code: Ni–203 Apr. 1974.

GE Alloy René41 Specification, Alloy Digest, Filing Code, Ni–47, Nov. 1958.

Inconel 718 Alloy Specification, Alloy Digest Filing Code Ni–65 Apr. 1961.

Waspaloy Alloy Specification, Alloy Digest, Filing Code Ni–129, Nov. 6–7.

SAE Aerospace Material Specification AMS 5707G, revised Jan. 1, 1989.

SAE Aerospace Material Specification AMS–5708. Rev. F, Revised Apr. 1990.

"The Influence of VIM Crucible Composition, Vacuum Arc Remelting and Electroslag Remelting on the Non–Metallic Inclusion Content of Merl 76" by Brown et al. Proccedings of the Fouth International Symposium on Superalloys, pp. 159–168. Sep. 1980.

400X

400X

1000X

Fracture Section 5000X

Fracture Section 5000X

NICKEL-COBALT BASED ALLOYS

This is a continuation of application Ser. No. 08/418,746, now U.S. Pat. No. 5,637,159 filed on Apr. 7, 1995, which is a continuation of Ser. No. 08/025,207 filed on Mar. 2, 1993, now U.S. Pat. No. 5,476,555, which is a continuation-in-part of application Ser. No. 07/938,104, filed Aug. 31, 1992, now abandoned.

BACKGROUND OF THE INVENTION

1. Field of the Invention

This invention relates to nickel-cobalt based alloys and, more particularly, high strength nickel-cobalt based alloys and articles made therefrom having increased thermal stability and microstructural stability at elevated temperatures.

2. Description of the Prior Art

There has been a continuing demand in the metallurgical industry for alloy compositions which have high strength combined with increased thermal stability and microstructural stability for use in applications subject to higher service temperatures. For example, advances over recent years in the design of gas turbines have resulted in engines which are capable of operating at higher temperatures, pressure ratios and rotational speeds, which assist in providing increased engine efficiencies and improved performance. Accordingly, alloys used to produce components in these engines, such as fastener components, must be capable of providing the higher temperature properties necessary for use in these advanced engines operating at the higher service temperatures.

Suggestions of the prior art for nickel-cobalt based alloys include U.S. Pat. No. 3,356,542, Smith, which discloses certain nickel-cobalt based alloys containing in weight percentage 13–25% chromium and 7–16% molybdenum. These alloys, which are commercially known as MP35N alloys, are claimed to be corrosion resistant and capable of being work-strengthened under certain temperature conditions, whereby very high ultimate tensile and yield strengths are developed (MP35N is a registered trademark of SPS Technologies, Inc., assignee of the present application). Furthermore, these alloys have phasial constituents which can exist in one or two crystalline structures, depending on temperature. They are also characterized by composition-dependent transition zones of temperatures in which transformations between phases occur. For example, at temperatures above the upper temperature limit of the transformation zone, the alloys are stable in the face-centered cubic ("FCC") structure. At temperatures below the lower temperature of the transformation zone, the alloys are stable in the hexagonal close-packed ("HCP") form. This transformation is sluggish and cannot be thermally induced. However, by cold working metastable face-centered cubic material at a temperature below the upper limit of the transformation zone, some of it is transformed into the hexagonal close-packed phase which is dispersed as platelets throughout a matrix of the face-centered cubic material. It is this cold working and phase transformation which is indicated to be responsible for the ultimate tensile and yield strengths of these alloys. However, the MP35N alloys described in the Smith patent have stress-rupture properties which make them unsuitable for use at temperatures above about 800° F.

U.S. Pat. No. 3,767,385, Slaney, discloses certain nickel-cobalt alloys, which are commercially known as MP159 alloys (MP159 is a registered trademark of SPS Technologies, Inc.). The MP159 alloys described in the Slaney '385 patent are an improvement on the Smith patent alloys. As described in the Slaney '385 patent, the composition of the alloys was modified by the addition of certain amounts of aluminum, titanium and columbium in order to take advantage of additional precipitation hardening of the alloy, thereby supplementing the hardening effect due to conversion of FCC to HCP phase. The alloys disclosed include elements, such as iron, in amounts which were formerly thought to result in the formation of disadvantageous topologically close-packed (TCP) phases such as the sigma, mu or chi phases (depending on composition), and thus thought to severely embrittle the alloys. But this disadvantageous result was said to be avoided with the invention of the Slaney patent. For example, the alloys of the Slaney patent are reported to contain iron in amounts from 6% to 25% by weight while being substantially free of embrittling phases.

According to the Slaney '385 patent, it is not enough to constitute the described alloys within the specified ranges in weight percentage of 18–40% nickel, 6–25% iron, 6–12% molybdenum, 15–25% chromium, 0 or 1–5% titanium, 0 or 0–1% aluminum, 0 or 0–2% columbium, 0–0.05% carbon, 0–0.1% boron, and balance cobalt. Rather, the alloys must further have an electron vacancy number ($N_v$), which does not exceed certain fixed values in order to avoid the formation of embrittling phases. The $N_v$ number is the average number of electron vacancies per 100 atoms of the alloy. By using such alloys, the Slaney '385 patent states that cobalt based alloys which are highly corrosion resistant and have excellent ultimate tensile and yield strengths can be obtained. These properties are disclosed to be imparted by formation of a platelet HCP phase in a matrix FCC phase and by precipitating a compound of the formula $Ni_3X$, where X is titanium, aluminum and/or columbium. This is accomplished by working the alloys at a temperature below the upper temperature of a transition zone of temperatures in which transformation between HCP phase and FCC phase occurs and then heat treating between 800° F. and 1350° .F for about 4 hours. Nevertheless, the MP159 alloys described in the Slaney '385 patent have stress-rupture properties which make them unsuitable for use at temperatures above about 1100° F.

Another suggestion of the prior art is U.S. Pat. No. 4,795,504, Slaney, which discloses alloys (known as MP210 alloys) having a composition in weight percentage of 0.05% max carbon, 20–40% cobalt, 6–11% molybdenum, 15–23% chromium, 1.0% max iron, 0.005–0.020% boron, 0–6% titanium, 0–10% columbium and the balance nickel. The alloys disclosed in this patent are said to retain satisfactory tensile and ductility levels and stress-rupture properties at temperatures of about 1300° F. In order to avoid formation of embrittling phases, such as the sigma phase, it is also disclosed that the electron vacancy number $N_v$ for these alloys cannot be greater than 2.80. Again, these alloys are disclosed as being strengthened by working at a temperature which is below the HCP-FCC transformation zone. Further, the alloys described in this patent, like those described in the above-mentioned Smith patent and Slaney '385 patent, are multiphase alloys forming an HCP-FCC platelet structure.

Additionally, U.S. Pat. No. 4,908,069, discloses an invention premised upon the recognition that advantageous mechanical properties (such as high strength), and high hardness levels, can be attained in certain alloy materials having high resistance to corrosion through formation of a gamma prime phase in those materials and the retention of a substantial gamma prime phase after the materials have been worked to cause formation of an HCP platelet phase in an FCC matrix. In one aspect, this patent describes a certain method of making a work-strengthenable alloy which includes a gamma prime phase. This method comprises: forming a melt containing, in percent by weight, 6–16% molybdenum, 13–25% chromium, 0–23% iron, 10–55% nickel, 0–0.05% carbon, 0–0.05% boron, and the balance (constituting at least 20%) cobalt, wherein the alloy also contains one or more elements which form gamma prime phase with nickel and has a certain defined electron vacancy number ($N_v$); cooling the melt; and heating the alloy at a temperature from 600°–900° C. for a time sufficient to form the gamma prime phase, prior to strengthening of the alloy by working it to achieve a reduction in cross-section of at least 5%.

Furthermore, U.S. Pat. No. 4,931,255, discloses nickel-cobalt alloys having, in weight percentage, 0–0.05% carbon, 6–11% molybdenum, 0–1% iron, 0–6% titanium, 15–23% chromium, 0.005–0.020% boron, 1.1–10% columbium, 0.4–4.0% aluminum, 30–60% cobalt and the balance nickel, wherein the alloys have a certain defined electron vacancy number ($N_v$).

Several of the alloys described in the above-mentioned patents, such as the MP35N alloy and MP159 alloy, have been utilized in aerospace fastener components. Additionally, the alloy commonly known as Waspaloy is widely used to make aerospace fastener components. Waspaloy has a composition reported in AMS 5707G and AMS-5708F Specifications of, in weight percentage, 0.02–0.10% carbon, 18.00–21.00% chromium, 12.00–15.00% cobalt, 3.50–5.00% molybdenum, 1.20–1.60% aluminum, 2.75–3.25% titanium, 0.02–0.08% zirconium, 0.003–0.010% boron, 0.10% max manganese, 0.15% max silicon, 0.015% max phosphorus, 0.015% max sulfur, 2.00% max iron, 0.10% max copper, 0.0005% max lead, 0.00003% max bismuth, 0.0003% max selenium, and the balance nickel. Nevertheless, there remains a need in the art to develop higher strength, higher temperature capability alloys, particularly for fastener components and other parts for higher temperature service, thus making it possible to construct turbine engines and other equipment for higher operating temperatures and greater efficiency than heretofore possible.

Although manufacturing process improvements, such as the method described in the aforementioned U.S. Pat. No. 4,908,069, may be able to provide useful enhancement of the properties of certain alloys, modification of the alloy chemistry tends to provide a much more commercially desirable and useful means to achieve the blend of properties desired for fastener components and other parts at higher service temperatures. Accordingly, the work which led to the present invention was undertaken to develop fastener materials primarily by means of increased alloying rather than process innovation. Selected properties generally considered important for fastener applications include: component produceability, tensile strength, stress- and creep-rupture strength, corrosion resistance, fatigue strength, shear strength and thermal expansion coefficient.

An alloy designer can attempt to improve one or two of these design properties by adjusting the compositional balance of known alloys. However, despite the teachings of the prior art, it is still not possible for those skilled in the art to predict with any significant degree of accuracy the physical and mechanical properties that will be displayed by certain concentrations of known elements used in combination to form such alloys. Furthermore, it is extremely difficult to improve more than one or two of the materials' engineering properties without significantly or even severely compromising the remaining desired characteristics. Alloy design is a procedure of compromise which attempts to achieve the best overall mix of properties to satisfy the various requirements of component design. Rarely is any one property maximized without compromising another property. Rather, through development of a critically balanced chemistry and proper processing to produce the component, the best compromise among the desired properties is achieved. The unique alloys of the present invention provide an excellent blend of the properties necessary for use in producing fastener components and other parts for higher temperature service, such as up to about 1400° F.

SUMMARY OF THE INVENTION

This invention relates to nickel-cobalt based alloys comprising the following elements in percent by weight: from about 0.002 to about 0.07 percent carbon, from about 0 to about 0.04 percent boron, from about 0 to about 2.5 percent columbium, from about 12 to about 19 percent chromium, from about 0 to about -6 percent molybdenum, from about 20 to about 35 percent cobalt, from about 0 to about 5 percent aluminum, from about 0 to about 5 percent titanium, from about 0 to about 6 percent tantalum, from about 0 to about 6 percent tungsten, from about 0 to about 2.5 percent vanadium, from about 0 to about 0.06 percent zirconium, and the balance nickel plus incidental impurities, the alloys having a phasial stability number $N_{v3B}$ less than about 2.60. Furthermore, the alloys have at least one element selected from the group consisting of aluminum, titanium, columbium, tantalum and vanadium. Also, the alloys have at least one element selected from the group consisting of tantalum and tungsten.

Although incidental impurities should be kept to the least amount possible, the alloys can also be comprised of from about 0 to about 0.15 percent silicon, from about 0 to about 0.15 percent manganese, from about 0 to about 2.0 percent iron, from about 0 to about 0.1 percent copper, from about 0 to about 0.015 percent phosphorus, from about 0 to about 0.015 percent sulfur, from about 0 to about 0.02 percent nitrogen, and from about 0 to about 0.01 percent oxygen.

The alloys of this invention have a platelet phase and a gamma prime phase dispersed in a face-centered cubic matrix. Moreover, the alloys are substantially free of embrittling phases. The alloys can be worked to achieve a reduction in cross-section of at least 5%. Also, the alloys can be aged after cold working or, alternatively, the alloys can be aged, cold worked to achieve the desired reduction in cross-section, and then aged again. This invention provides alloys having an increased thermal stability and microstructural stability at elevated temperatures, particularly up to about 1400° F.

Articles for use at elevated temperatures can be suitably made from the alloys of this invention. The article can be a component for turbine engines or other equipment subjected to elevated operating temperatures and, more particularly, the component can be a fastener for use in such engines and equipment.

The nickel-cobalt based alloy compositions of this invention have critically balanced alloy chemistries which result in unique blends of desirable properties at elevated temperatures. These properties include: component produceability, particularly for fastener components; very good tensile strength, excellent stress-rupture strength, very good corrosion resistance, very good fatigue strength, very good shear strength, excellent creep-rupture strength up to about 1500° F. and a desirable thermal expansion coefficient.

Accordingly, it is an object of the present invention to provide nickel-cobalt based alloy compositions and articles made therefrom having unique blends of desirable properties. It is a further object of the present invention to provide nickel-cobalt based alloys and articles made therefrom for use in turbine engines and other equipment under high stress, high temperature conditions, such as up to about 1400° F. These and other objects and advantages of the present invention will be apparent to those skilled in the art upon reference to the following detailed description of the preferred embodiments.

DESCRIPTION OF THE PREFERRED EMBODIMENTS

Figure 1:
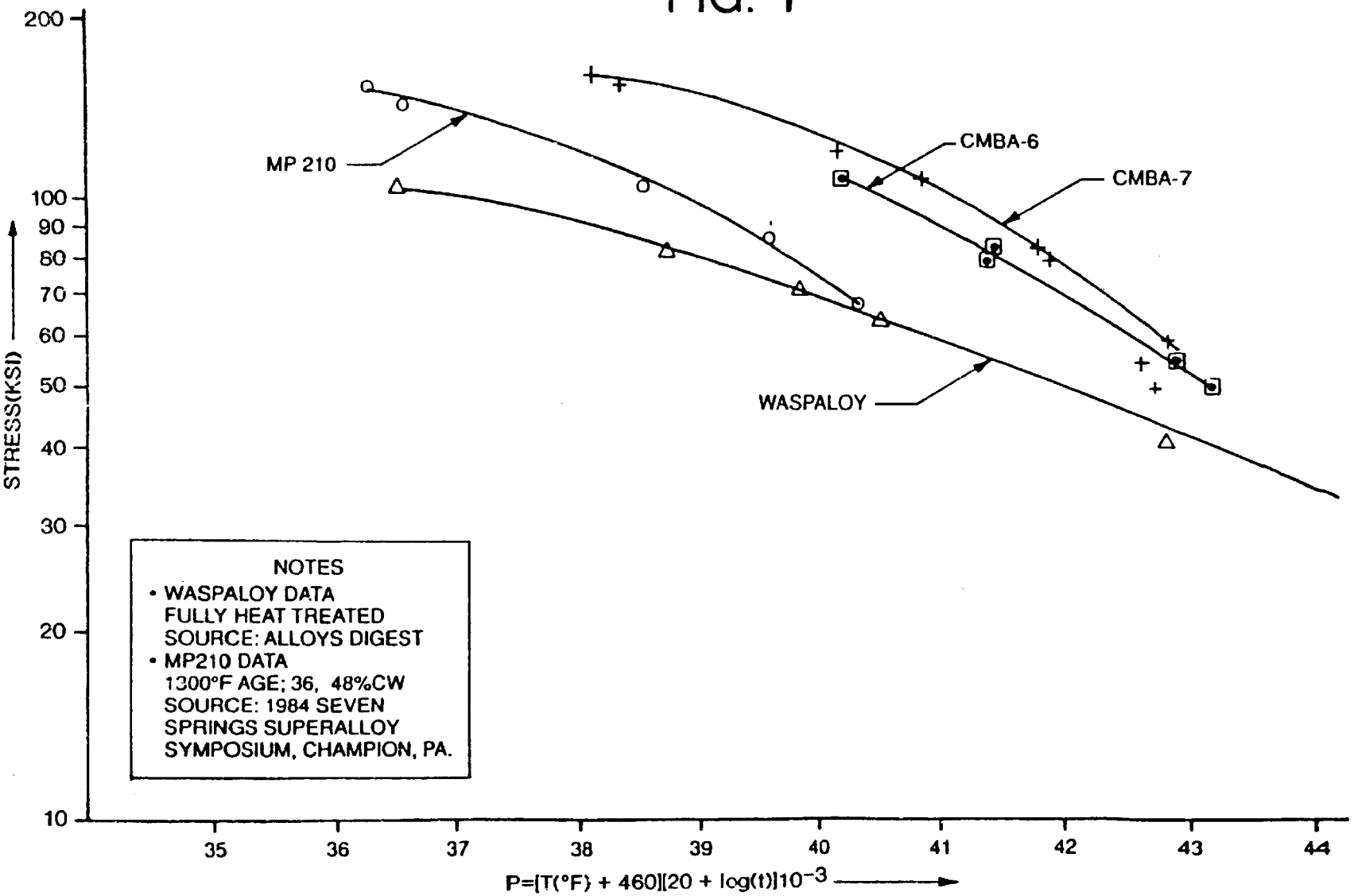
FIG. 1 is a Larson Miller stress-rupture plot comparing results from CMBA-6 and CMBA-7 alloy samples of the present invention to those of prior art Waspaloy and MP210 alloys.

The nickel-cobalt based alloys of the present invention comprise the following elements in percent by weight:

| | |
|---|---|
| Carbon | about 0.002–0.07 |
| Boron | about 0–0.04 |
| Columbium | about 0–2.5 |
| Chromium | about 12–19 |

-continued

| | |
|---|---|
| Molybdenum | about 0–6 |
| Cobalt | about 20–35 |
| Aluminum | about 0–5 |
| Titanium | about 0–5 |
| Tantalum | about 0–6 |
| Tungsten | about 0–6 |
| Vanadium | about 0–2.5 |
| Zirconium | about 0–0.06 |
| Nickel + Incidental Impurities | Balance |

These alloys have a phasial stability number $N_{v3B}$ less than about 2.60. Further, these alloys have at least one element selected from the group consisting of aluminum, titanium, columbium, tantalum and vanadium, and these alloys also have at least one element selected from the group consisting of tantalum and tungsten. These alloy compositions have critically balanced alloy chemistries which result in unique blends of desirable properties, which are particularly suitable for use in producing fastener components. These properties include increased thermal stability, microstructural stability, and stress- and creep-rupture strength at elevated temperatures, particularly up to about 1400° F., relative to prior art nickel and nickel-cobalt based alloys which are used to produce fastener components.

Major factors which restrict the higher temperature strength of prior art alloys, such as the MP159 alloy, include the instability of the solid solution and gamma prime strengthening phases at higher temperature. Prolonged exposure at elevated temperatures in such materials can result in the dissolution of desired strengtheners and reprecipitation of non-cubic, ductility- and strength-deterring phases. The MCP to FCC transus temperature in these prior art alloys and the thermal stability of the strengthening phases can be improved by alloy additions. The elements which normally form the gamma-prime phase are nickel, titanium, aluminum, columbium, vanadium and tantalum, while the matrix is dominated by nickel, chromium, cobalt, molybdenum and tungsten. The alloys of the present invention are balanced with such elements to provide relatively high HCP/FCC transus temperature, microstructural stability and stress/creep-rupture strength.

The alloys of the present invention have a tantalum content of about 0–6% by weight and a tungsten content of about 0–6% by weight. Both tantalum and tungsten can be present in the alloys of the present invention. However, at least one of the elements tantalum and tungsten must be present. Advantageously, the tantalum content is from 3.8 percent to 5.0 percent by weight, and the tungsten content is from 1.8 percent to 3.0 percent by weight. In the present alloys, tungsten and tantalum may contribute to increasing the FCC/HCP transus temperature. Concurrently, these elements provide significant solid solution strengthening to the alloys due to their relatively large atomic diameter and, therefore, are important additions for strength retention while potentially allowing an increase in ductility through lower cold work levels. The lower cold work levels are possible since the alloys of the present invention do not depend exclusively upon cold work for strength attainment.

This invention's alloys must also have at least one gamma-prime forming element selected from the group consisting of aluminum, titanium, columbium, tantalum and vanadium. The aluminum content is about 0–5 percent by weight, and the titanium content is about 0–5 percent by weight. Advantageously, aluminum is present in an amount from 0.9 percent to 1.1 percent by weight, and titanium is present in an amount from 1.9 percent to 4.0 percent by weight. The aluminum and titanium additions in these compositions promote gamma-prime formation. Furthermore, it is believed that the strength and volume fraction of the gamma-prime phase is increased through the additions of tantalum and columbium to these alloys, thereby increasing the alloys' strength. The elements aluminum, titanium and tantalum are also effective in these alloys toward providing improved environmental properties, such as resistance to hot corrosion and oxidation.

The columbium content is about 0–2.5 percent by weight and, advantageously, columbium is present in an amount from 0.9 percent to 1.3 percent by weight. The amount of tantalum that can be added to these alloys is higher than columbium since, besides partitioning to the gamma prime, tantalum contributes favorably to the alloys' matrix. It is a more effective strengthener than columbium due to its greater atomic diameter.

Gamma-prime phase formation is promoted in these alloys since it assists the attainment of the high strength. Additionally, a significant volume fraction of gamma prime is desired since it may assist in the materials' response to various types of processing, such as methods which involve aging first, then cold working, followed by a further aging treatment; such methods potentially lowering the amount of cold work required for strength attainment in this type of material.

The vanadium content in these compositions is about 0–2.5 percent by weight. Advantageously, the vanadium content is from 0 to 0.01 percent by weight. The alloys of this invention further have a carbon content of about 0.002–0.07 percent by weight and, advantageously, carbon is present in an amount from 0.005 percent to 0.03 percent by weight. Carbon is added to these alloys since it assists with melt deoxidation during the VIM production process, and may contribute to grain boundary strength in these alloys. Additionally, the boron content is about 0–0.04 percent by weight and, advantageously, the amount of boron is from 0.01 percent to 0.02 percent by weight. Boron is added to these alloys within the specified range in order to improve grain boundary strength.

The chromium content is about 12–19 percent by weight. Advantageously, the amount of chromium in the alloys of the present invention is from 13.0 percent to 17.5 percent by weight. Chromium provides corrosion resistance to these alloys, although it may also assist with the alloys' resistance to oxidation. Furthermore, the molybdenum content is about 0–6 percent by weight and, advantageously, the molybdenum content is from 2.7 percent to 4.0 percent by weight. The addition of molybdenum to these compositions is a means of improving the strength of the alloys. Moreover, the zirconium content is about 0–0.06 percent by weight. Advantageously, zirconium is present in an amount from 0 to 0.02 percent by weight. Zirconium also improves grain boundary strength in these alloys.

The cobalt content is about 20–35 percent by weight. Advantageously, the cobalt content is from 24.5 to 34.0 percent by weight. Cobalt assists in providing a stable multiphase structure and possibly corrosion resistance to these alloys. The balance of this invention's alloy compositions is comprised of nickel and small amounts of incidental impurities. Generally, these incidental impurities are entrained from the industrial process of production, and they should be kept to the least amount possible in the compositions so that they do not affect the advantageous aspects of the alloys.

For example, these incidental impurities may include up to about 0.15 percent by weight silicon, up to about 0.15 percent by weight manganese, up to about 2.0 percent by weight iron, up to about 0.1 percent by weight copper, up to about 0.015 percent by weight phosphorus, up to about 0.015 percent by weight sulfur, up to about 0.02 percent by weight nitrogen and up to about 0.01 percent by weight oxygen. Amounts of these impurities which exceed the stated amounts could have an adverse effect upon the resulting alloy's properties. Preferably, these incidental impurities do not exceed: 0.025 percent by weight silicon, 0.01 percent by weight manganese, 0.1 percent by weight iron, 0.01 percent by weight copper, 0.01 percent by weight phosphorus, 0.002 percent by weight sulfur, 0.001 percent by weight nitrogen and 0.001 percent by weight oxygen.

Not only do the alloys of this invention have a composition within the above specified ranges, but they also have a phasial stability number $N_{v38}$ less than about 2.60. Advantageously, the phasial stability number $N_{v38}$ is less than 2.50. As can be appreciated by those skilled in the art, $N_{v38}$ is defined by the PWA N-35 method of nickel-based alloy electron vacancy TCP phase control factor calculation. This calculation is as follows:

EQUATION 1

Conversion for weight percent to atomic percent:
Atomic percent of element i, designated Pi $$P_i = \frac{W_i/A_i}{\Sigma(W_i/A_i)} \times 100$$

where:

$W_i$=weight percent of element i $A_i$=atomic weight of element i

EQUATION 2

Calculation for the amount of each element present in the continuous matrix phase:

| Element | Atomic Amount $R_i$ in Matrix Phase |
|---|---|
| Cr | $R_{Cr} = 0.97P_{Cr} - 0.375P_B - 1.75P_C$ |
| Ni | $R_{Ni} = P_{Ni} + 0.525P_B - 3(P_{Al} + 0.03P_{Cr} + P_{Ti} - 0.5P_C + 0.5P_V + P_{Ta} + P_{Cb})$ |
| Ti, Al, B, C, Ta, Cb | $R_i = 0$ |
| V | $R_V = 0.5P_V$ |
| W | $R_W = P_W - 0.167P_C \frac{P_W}{P_{Mo} + P_W}$ |
| Mo | $R_{Mo} = P_{Mo} - 0.75P_B - 0.167P_C \frac{P_{Mo}}{(P_{Mo} + P_W)}$ |

EQUATION 3

Calculation of $N_{v38}$ using atomic factors from Equations 1 and 2 above:

$$N_i i = \frac{R_i}{\Sigma R_i}$$

then $$N_{v3B} = \Sigma N_i i(N_v)i$$

where:

i=each individual element in turn.

$N_i$i=the atomic factor of each element in matrix.

$(N_v)$i=the electron vacancy No. of each respective element.

This calculation is exemplified in detail in a technical paper entitled "PHACOMP Revisited", by H. J. Murphy, C. T. Sims and A. M. Beltran, published in Volume 1 of International Symposium on Structural Stability in Superalloys (1968), the disclosure of which is incorporated by reference herein. As can be appreciated by those skilled in the art, the phasial stability number for the alloys of this invention is critical and must be less than the stated maximum to provide a stable microstructure and capability for the desired properties under high temperature conditions. The phasial stability number can be determined empirically, once the practitioner skilled in the art is in possession of the present subject matter.

The alloys of the present invention exhibit increased thermal stability and microstructural stability, such as resistance to formation of undesirable TCP phases, at elevated temperatures up to about 1400° F. Furthermore, this invention provides alloy compositions having unique blends of desirable properties. These properties include: component produceability, particularly for fastener components; very good tensile strength, excellent stress-rupture life, very good corrosion resistance, very good fatigue strength, very good shear strength, a desirable thermal expansion coefficient, and excellent resistance to creep under high stress, high temperature conditions up to about 1500° F. One embodiment of this invention has the capability of withstanding 29 ksi stress at 1300° F. for 1000 hours before exhibiting 0.1% creep deformation and 45 ksi stress at 1300° F. for 1000 hours before exhibiting 0.2% creep deformation. The alloys have a multiphase structure with a platelet phase and a gamma prime phase dispersed in a face centered cubic matrix, which is believed to be a factor in providing the improved higher temperature properties of these alloys. These alloys are also substantially free of embrittling phases. Nevertheless, as noted above, the alloys of this invention have precise compositions with only small permissible variations in any one element if the unique blend of properties is to be maintained.

This invention's alloys can be used to suitably make articles for use at elevated temperatures, particularly up to about 1400° F. The article can be a component for turbine engines or other equipment subjected to elevated operating temperatures. However, the alloy compositions of this invention are particularly useful in making high strength fasteners having increased thermal stability and microstructural stability at elevated temperatures up to about 1400° F., while maintaining extremely good mechanical strength and corrosion resistance. Examples of fastener parts which can be suitably made from the alloys of this invention include bolts, screws, nuts, rivets, pins and collars. These alloys can be used to produce a fastener having an increased resistance to creep under high stress, high temperature conditions up to about 1500° F., as well as a stress-rupture life at 1300° F./100 ksi condition greater than 150 hours, which are considered important alloy properties that are highly desirable when producing fasteners for use in turbine engines and other equipment subjected to elevated operating temperatures.

The alloy compositions of this invention are suitably prepared and melted by any appropriate technique known in the art, such as conventional ingot metallurgy techniques or by powder metallurgy techniques. Thus, the alloys can be first melted, suitably by vacuum induction melting (VIM), under appropriate conditions, and then cast as an ingot. After casting as ingots, the alloys are preferably homogenized and then hot worked into billets or other forms suitable for subsequent working. However, evaluations of the present invention undertaken with larger diameter VIM product revealed that ingot microstructural variation and elemental segregation may adversely affect the yield of hot reduced product for alloys of this invention. For this reason, it may be desirable to vacuum arc remelt (VAR) or electroslag remelt (ESR) the alloys before they are worked and aged.

ESR and VAR are two types of consumable electrode melting processes that are well known in the art. In these processes, a VIM ingot (electrode) is progressively melted from one end to the other with the resulting molten pool of metal resolidified under controlled conditions, producing an ingot with reduced elemental segregation and improved microstructure as compared to the starting VIM electrode. In the VAR process, the melting and resolidification may occur in vacuum which may reduce the level of high vapor pressure tramp elements in the melt. ESR is carried out using a molten refining slag layer between the electrode and the resolidifying ingot. As molten metal droplets descend from the electrode through the molten slag, compositional refining and removal of impurities can occur prior to resolidification in the ingot. The improved microstructure and reduction in elemental segregation imparted to the resulting ingot by either of these consumable electrode melting processes results in improved response to subsequent heat treating and hot working operations.

Alternatively, the molten alloy can be impinged by gas jet or otherwise dispersed as small droplets to form powders. Powdered alloys of this sort can then be densified into a desired shape according to techniques known in powder metallurgy. Also, spray casting techniques known in the art can be utilized.

The alloys of the present invention are advantageously worked to achieve a reduction in cross-section of at least 5 percent. In a preferred embodiment, the alloy is cold worked to achieve a reduction in cross-section of from about 10% to 40%, although higher levels of cold work may be used with some loss of functionality. As used herein, the term "cold working" means deformation at a temperature (below the FCC/HCP transus temperature) which will induce the transformation of a portion of the metastable FCC matrix into the platelet phase. Also as used herein, the term "hot working" means deformation at a temperature above the FCC/HCP transus temperature.

The alloys can be aged after cold working. For example, the alloys can be aged for about 1 to about 50 hours after cold working. The alloys are advantageously aged at a temperature of from about 800° F. to about 1400° F. for about 1 hour to about 50 hours after cold working. Alternatively, the alloys can be first aged, cold worked to achieve a reduction in cross-section of at least 5%, and then aged again. Advantageously, the alloys are aged at a temperature of from about 1200° F. to about 1650° F. for about 1 hour to about 200 hours, cold worked to achieve a reduction in cross-section of about 10% to 40% and then aged again at a temperature of from about 800° F. to about 1400° F. for about 1 hour to about 50 hours. Following aging, the alloys may be air-cooled.

The present invention further encompasses processes for producing nickel-cobalt based alloys having the compositions as described above. In one embodiment, this process comprises:

(a) forming a melt comprising the following elements in percent by weight:

| | |
|---|---|
| Carbon | about 0.002–0.07 |
| Boron | about 0–0.04 |
| Columbium | about 0–2.5 |
| Chromium | about 12–19 |
| Molybdenum | about 0–6 |
| Cobalt | about 20–35 |
| Aluminum | about 0–5 |
| Titanium | about 0–5 |
| Tantalum | about 0–6 |
| Tungsten | about 0–6 |
| Vanadium | about 0–2.5 |
| Zirconium | about 0–0.06 |
| Nickel + Incidental Impurities | Balance |

the alloy having a phasial stability number $N_{v3B}$ less than about 2.60, wherein the alloy has at least one element selected from the group consisting of aluminum, titanium, columbium, tantalum and vanadium, and the alloy also has at least one element selected from the group consisting of tantalum and tungsten;

(b) cooling the melt to form solid alloy material;

(c) hot working the solid alloy material to reduce the material to a size suitable for cold working;

(d) cold working the alloy material to achieve a reduction in cross-section of at least 5%; and (e) aging the cold-worked alloy material at a temperature of from about 800° F. to about 1400° F. for about 1 to about 50 hours.

As noted above, the alloys can be vacuum arc remelted or electroslag remelted before being worked and aged. The alloys can also be aged first, cold worked to achieve the necessary reduction in cross-section, and then aged again. For example, the alloys can first be aged at a temperature of from about 1200° F. to about 1650° F. for about 1 hour to about 200 hours before being cold worked to achieve a reduction in cross-section of at least 5%. However, as can be appreciated by those skilled in the art, the optimum temperatures and times for cold working and aging in all of the above processing steps depends on the precise composition of the alloy. Additionally, the cold worked alloy can be air-cooled after aging. The process of this invention can be suitably used to make alloys for production of fasteners.

In order to more clearly illustrate this invention, the examples set forth below are presented. The following examples are included as being illustrations of the invention and its relation to other alloys and articles, and should not be. construed as limiting the scope thereof.

Four different alloy processing methods were undertaken during the evaluation to determine the compositions of this invention. Generally, the processing methods employed, corresponding to Examples 1, 2, 3, 4 and 5 set forth below, were as follows:

1. VIM+Hot Extrusion+Hot Roll+Cold Work (swaging)
2. VIM+Hot Extrusion+Hot Roll+Cold Draw
3. VIM+ESR+Hot Roll+Cold Roll
4. VIM+ESR+Hot Roll+Cold Draw
5. VIM+ESR+Hot Roll+Cold Draw

EXAMPLE 1

The experimental development work which resulted in the compositions of the present invention began with the definition of two alloy systems, designated CMBA-6 and CMBA-7. Follow-on work defined a third alloy system, designated CMBA-8. The developmental compositions were designed to exhibit multiphase-type reaction, i.e., partial transformation with cold work of the metastable FCC matrix to its lower temperature HCP structure, while also utilizing more conventional strengthening mechanisms.

Initially, two inch diameter bars of the CMBA-6 and CMBA-7 alloy compositions were produced. The melting was done in a vacuum furnace, which operated with an argon backfill. The aim chemistries and actual cast ingot chemistries for the CMBA-6 and CMBA-7 alloy samples are presented in Table 1 below. Similarly, the aim chemistry and actual cast ingot chemistry for the subsequently produced CMBA-8 alloy sample is also presented in Table 1.

It is believed that fairly good correlation of alloy aim chemistry to actual cast ingot content prevailed. Additionally, standard $N_{v3B}$ calculations (discussed above) were performed to assist with respective alloy phasial stability predictions, with the results also presented in Table 1 below.

TABLE 1

| | Weight % | | | | | |
|---|---|---|---|---|---|---|
| | CMBA-6 | | CMBA-7 | | CMBA-8 | |
| Element | Aim | Cast Ingot | Aim | Cast Ingot | Aim | Cast Ingot |
| C | .015 | .010 | .105 | .020 | .015 | .024 |
| Si | LAP | <.05 | LAP | <.05 | LAP | .004 |
| Mn | LAP | <.05 | LAP | <.05 | LAP | .001 |
| B | .015 | .018 | .015 | .016 | .015 | .014 |
| Cb | 1.1 | 1.2 | 1.1 | 1.1 | 1.1 | 1.1 |
| Cr | 17.0 | 16.9 | 17.0 | 17.0 | 14.5 | 14.6 |
| Mo | 3.0 | 2.9 | 3.5 | 3.4 | 3.5 | 3.5 |
| Co | 25.0 | 24.1 | 30.0 | 28.4 | 33.0 | 33.1 |
| Al | 1.0 | 1.06 | 1.0 | 1.03 | 1.0 | .96 |
| Ti | 2.0 | 1.98 | 3.0 | 3.1 | 3.5 | 3.7 |
| Ta | 4.0 | 3.9 | 4.0 | 3.9 | 4.5 | 4.3 |
| W | 2.0 | 1.9 | 2.0 | 1.9 | 2.5 | 2.4 |
| V | LAP | <.01 | LAP | <.01 | LAP | <.01 |
| Ni | BASE | BASE | BASE | BASE | BASE | BASE |
| Fe | LAP | <.05 | LAP | <.10 | LAP | <.05 |
| Cu | LAP | <.02 | LAP | <.02 | LAP | .003 |
| S ppm | LAP | 7 | LAP | 6 | LAP | 16 |
| [N] ppm | LAP | 25 | LAP | 100 | LAP | 6 |
| [O] ppm | LAP | 36 | LAP | 40 | LAP | 28 |
| $N_{v3B}$ (PWA N-35) | 2.23 | 2.21 | 2.45 | 2.43 | 2.45 | 2.46 |

LAP - low as possible

The CMBA-6 and CMBA-7 alloys were homogenized as follows: the CMBA-6 sample was soaked at 2150° F. for approximately 27 hours, and the CMBA-7 sample was soaked at 2225° F. for approximately 46 hours. The CMBA-8 ingot, which was subsequently produced, was used to develop the alloy solution/homogenization treatment utilized in the Example 3 below.

Following homogenization, the CMBA-6 and CMBA-7 alloys were surface cleaned to remove oxide scale, and subsequently canned with stainless steel in preparation for extrusion. The test bars were extruded at 2100° F., at a reduction ratio of 2.56:1, to 1.25 inch diameter bar.

Subsequent to hot extrusion, the samples were subjected to hot rolling and cold swaging. The 14 inch long, 1.25 inch diameter canned bars were hot reduced at 2125° F. to a nominal 0.60 inch diameter through a total of 14 passes on a 14 inch mill. Five swage passes at room temperature resulted in cold work level ranging 25–34%, with reduction to diameter of 0.012–0.030 inches per pass.

Most of these test materials were aged at 1325° F./10 Hr./AC (air-cooled) test condition following cold work. Other test samples were aged for 20 hours at temperatures in the 1325°–1500° F. range, and limited room temperature and elevated temperature tensile tests were undertaken.

The aged specimens were machined/ground, and then tensile, stress-rupture and creep-rupture tested; all in accordance with standard ASTM procedures.

The results of tensile tests performed at room temperature (RT), 900° F., 1100° F., 1200° F. and 1300° F. with CMBA-6 and CMBA-7 alloy samples are presented below in Tables 2 and 3 respectively.

TABLE 2

LONGITUDINAL TENSILE PROPERTY COMPARISON CMBA-6 vs. WASPALOY

| Test Temp (°F./°C.) | Alloy | 0.2% Yield (KSI) | UTS (KSI) | ELONG (%) | RA (%) |
|---|---|---|---|---|---|
| RT | WASPALOY | 130.0 | 190.0 | 22.0 | 25.0 |
| | CMBA-6 | 276.1 | 284.8 | 5.5 | 18.5 |
| 900/482 | CMBA-6 | 237.3 | 243.2 | 6.1 | 23.9 |
| 1100/593 | WASPALOY | 117.5* | 177.5* | 18.5* | 27.5* |
| | CMBA-6 | 233.5 | 238.9 | 5.8 | 20.8 |
| 1200/649 | WASPALOY | 115.0 | 175.0 | 15.0 | 30.0 |
| | CMBA-6 | 227.5 | 235.8 | 6.1 | 22.4 |
| 1300/704 | WASPALOY | 112.5** | 152.5** | 21.0** | 40.0** |
| | CMBA-6 | 214.0 | 227.0 | 4.6 | 14.5 |

Notes:
CMBA 6 -- 27% Cold Worked Bar Specimens.
WASPALOY -- Forged and Fully Heat Treated to Rockwell C38 (Method "B"); Source: Engineering Alloys Digest, Inc., Upper Montclair, New Jersey.
*Average result calculated from 1000° F. and 1200° reported values.
**Average result calculated from 1200° F. and 1400° F. reported values.

TABLE 3

LONGITUDINAL TENSILE PROPERTY COMPARISON CMBA-7 vs. WASPALOY

| Test Temp (°F./°C.) | Alloy | 0.2% Yield (KSI) | UTS (KSI) | ELONG (%) | RA (%) |
|---|---|---|---|---|---|
| RT | WASPALOY | 130.0 | 190.0 | 22.0 | 25.0 |
| | CMBA-7 | 296.3 | 304.9 | 2.3 | 5.6 |
| 900/482 | CMBA-7 | 257.8 | 265.7 | 6.3 | 16.1 |
| 1100/593 | WASPALOY | 117.5* | 177.5* | 18.5* | 27.5* |
| | CMBA-7 | 248.2 | 261.9 | 3.8 | 13.1 |
| 1200/649 | WASPALOY | 115.0 | 175.0 | 15.0 | 30.0 |
| | CMBA-7 | 252.3 | 259.0 | 6.3 | 13.1 |
| 1300/704 | WASPALOY | 112.5** | 152.5** | 21.0** | 40.0** |
| | CMBA-7 | 239.3 | 249.6 | 5.3 | 14.3 |

Notes:
CMBA 7 -- Approximately 30% Cold Worked Bar Specimens.
WASPALOY -- Forged and Fully Heat Treated to Rockwell C38 (Method "B"); Source: Engineering Alloys Digest, Inc., Upper Montclair, New Jersey.
*Average result calculated from 1000° F. and 1200° F. reported values.
**Average result calculated from 1200° F. and 1400° F. reported values.

The CMBA-6 tensile test results presented in Table 2 are compared to typical Waspaloy properties. In general, these results indicate that CMBA-6 provides much higher tensile strength than Waspaloy, but with lower ductility.

Similarly, the CHBA-7 tensile test results presented in Table 3 illustrate the alloy provides even greater advantage over Waspaloy, but again, with considerably lower ductility.

Test results from a study of the effects of aging temperature variation on the CMBA-7 alloy are presented in Table 4 below.

TABLE 4

CMBA-7 RT LONGITUDINAL TENSILE STRENGTH RESULTS OF AGING TEMPERATURE VARIATION

| Age Condition | 0.2% Yield (KSI) | UTS (KSI) | ELONG (%) | RA (%) |
|---|---|---|---|---|
| 1325° F./20 hrs. | 303.7 | 309.9 | 2.3 | 6.8 |
| 1350° F./20 hrs. | 296.3 | 306.2 | 2.7 | 6.8 |
| 1375° F./20 hrs. | 300.0 | 307.4 | 2.4 | 8.0 |
| 1400° F./20 hrs. | 292.2 | 300.8 | 2.1 | 5.7 |
| 1450° F./20 hrs. | 282.6 | 294.8 | 1.5 | 3.6 |
| 1500° F./20 hrs. | 270.9 | 282.0 | 2.3 | 7.0 |

Notes:
Round bar test specimens, approximately 30% cold work

The results presented in Table 4 show that increasing the CMBA-7 aging temperature (above 1325° F.) did not improve the alloy's RT tensile ductility.

The results of stress- and creep-rupture tests performed with CMBA-6 and CMBA-7 alloy samples are presented in Table 5 below.

TABLE 5

ELEVATED TEMPERATURE STRESS - AND CREEP-RUPTURE DATA CMBA-6 AND CMBA-7 ALLOYS

| Alloy | Test Condition | Rupture Time Hours | % EL (4D) | RA % | Final Creep Reading t, Hours | Final Creep Reading % Deformation | Time in Hours to Reach 1.0% | Time in Hours to Reach 2.0% |
|---|---|---|---|---|---|---|---|---|
| CMBA-6 | 1200° F./154.0 ksi | 33.0+ | — | — | 31.4 | 0.261 | — | — |
| | 1200° F./154.0 ksi | 205.2++ | — | — | — | — | — | — |
| | 1300° F./107.5 ksi | 644.4 | 3.9 | 4.6 | 641.3 | 2.510 | 362.7 | 605.0 |
| | 1300° F./80.0 ksi | 5240.4 | 4.1 | 7.0 | 5238.7 | 3.066 | 3095.4 | 4881.0 |
| | 1350° F./84.0 ksi | 715.0 | 3.3 | 5.7 | 714.9 | 2.452 | 447.4 | 694.1 |
| | 1400° F./80.0 ksi | 168.9 | 2.8 | 4.4 | 168.3 | 2.514 | 52.0 | 145.3 |
| | 1450° F./55.0 ksi | 271.1 | 4.6 | 4.4 | 269.6 | 3.531 | 150.4 | 233.4 |
| | 1500° F./50.0 ksi | 102.0 | 4.5 | 5.8 | — | — | — | — |
| CMBA-7 | 1100° F./160.0 ksi | 25554.7 | 5.0 | 7.0 | — | — | — | — |
| | 1200° F./154.0 ksi | 6.6+ | — | — | 5.3 | 0.215 | — | — |

TABLE 5-continued

ELEVATED TEMPERATURE STRESS - AND CREEP-RUPTURE DATA
CMBA-6 AND CMBA-7 ALLOYS

| Alloy | Test Condition | Rupture Time Hours | % EL (4D) | RA % | Final Creep Reading t, Hours | Final Creep Reading % Deformation | Time in Hours to Reach 1.0% | Time in Hours to Reach 2.0% |
|---|---|---|---|---|---|---|---|---|
| | 1200° F./154.0 ksi | 1183.7 | 4.8 | 9.4 | 1179.5 | 3.018 | 484.0 | 946.0 |
| | 1200° F./120.0 ksi | 14679.5 | 10.3 | 16.1 | — | 9.058 | 5360.0 | 11989.9 |
| | 1200° F./100.0 ksi | 25618.4 | Test terminated at 1.099% Deformation | | | | 22854.0 | — |
| | 1300° F./107.5 ksi | 1523.3 | 10.3 | 19.6 | 1521.0 | 8.678 | 564.9 | 1151.8 |
| | 1300° F./80.0 ksi | 6725.4 | 10.3 | 17.1 | 6724.6 | 9.828 | 2510.0 | 5055.0 |
| | 1350° F./84.0 ksi | 1154.9 | 9.3 | 16.4 | 1154.9 | 9.015 | 437.1 | 831.9 |
| | 1400° F./80.0 ksi | 304.9 | 11.5 | 15.1 | 304.7 | 10.901 | 72.6 | 181.0 |
| | 1400° F./60.0 ksi | 994.4 | 8.2 | 14.5 | 993.0 | 7.479 | 423.5 | 710.1 |
| | 1450° F./55.0 ksi | 277.9 | 8.0 | 10.4 | 276.1 | 7.165 | 107.0 | 183.0 |
| | 1450° F./55.0 ksi | 190.9 | 6.1 | 8.2 | 187.3 | 4.267 | 65.9 | 132.9 |
| | 1500° F./50.0 ksi | 60.6 | 5.3 | 3.8 | — | — | — | — |
| | 1350° F./84.9 ksi | 571.6* | — | — | — | — | — | — |

Notes:
Test bar prep: Solution, hot extrude, hot roll, approx. 25% cold work, then aged.
Test specimens machined/ground for testing.
Predominately 0.160" dia. gage specimens.
+Thread failure.
++Interrupted test. Thread rolled specimen. Furnace shutdown at 87.0 hrs. and load continued for 15 hrs. while furnace was repaired.
*Notched rupture specimen.

The test results presented in Table 5 indicate that the CMBA-7 composition exhibits greater creep-rupture strength than the CMBA-6 composition. A specific example of this is provided in Table 5 wherein comparison of time to 1.0% and 2.0% creep for the two alloys tested at the 1300° F./107.5 ksi condition shows the CMBA-7 sample creeping at a significantly lower rate. The test results presented in Table 5 further indicate that the CMBA-7 composition also provides greater rupture strength and rupture ductility than the CMBA-6 composition. Additionally, some of the rupture results tabulated are graphically represented in FIG. 1 where a Larson Miller stress-rupture plot provides a comparison of the alloys' capabilities. For a running stress of 107.5 ksi, it is calculated that the CMBA-7 alloy provides a 21° F. metal temperature advantage relative to CMBA-6 alloy. Similarly, a 16° F. advantage is indicated at 80.0 ksi.

FIG. 1 also plots the elevated temperature rupture capability of Waspaloy and MP 210 (the alloy disclosed in the aforementioned U.S. Pat. No. 4,795,504). It is apparent that for the 100 ksi stress level, CMBA-7 alloy provides approximate respective metal temperature advantages of 71° F. over MP210 alloy and 127° F. over Waspaloy. Similarly, for 80 ksi stressed exposure, the alloy exhibits approximately 64° F. advantage vs. MP210 alloy and 94° F. advantage relative to Waspaloy.

Figure 2:
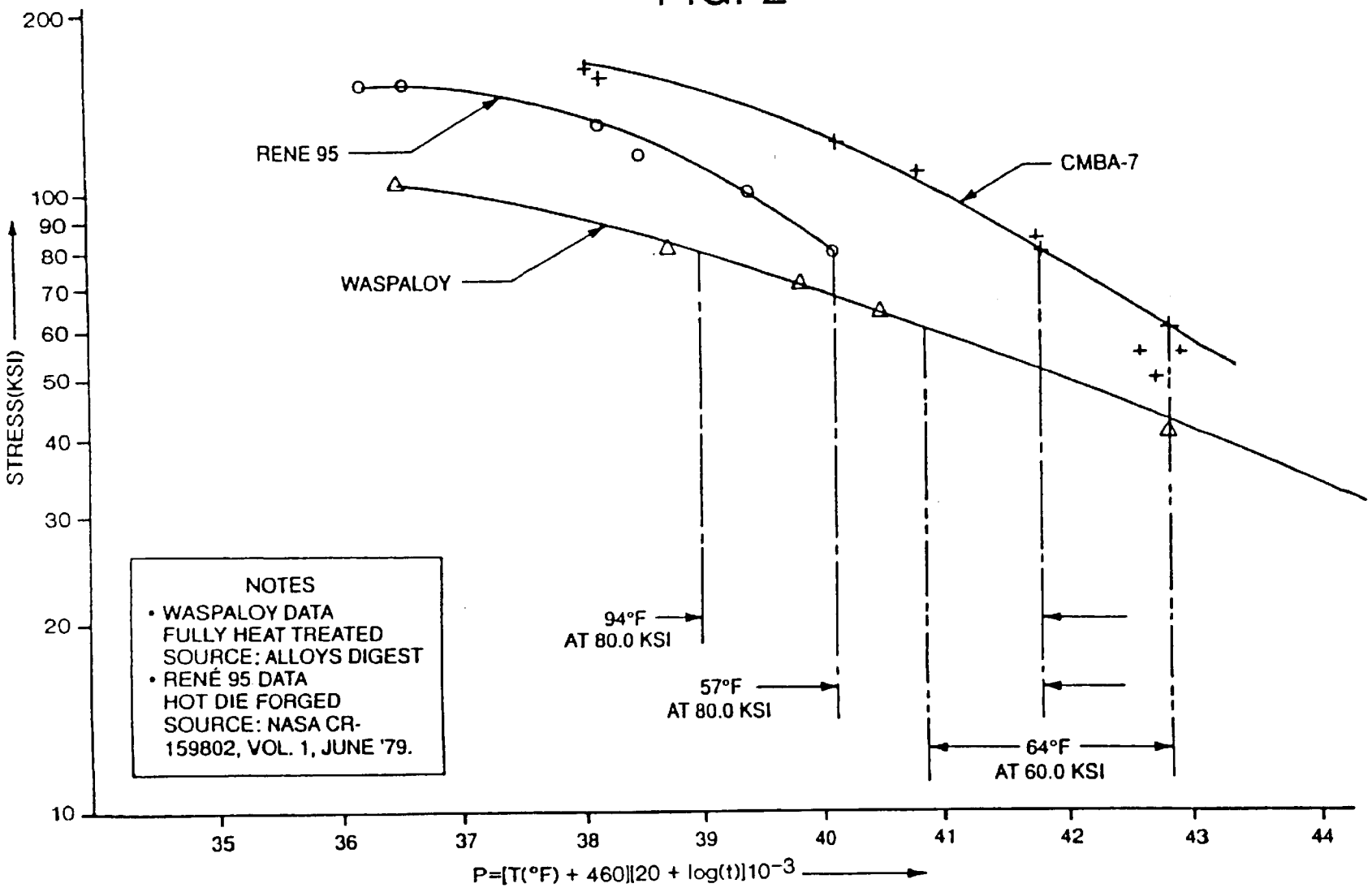
FIG. 2 is a Larson Miller stress-rupture plot comparing results from CMBA-7 alloy samples of the present invention to those of prior art Waspaloy and Rene 95 alloys.

FIG. 2 is another Larson Miller stress-rupture plot comparing the CMBA-7 alloy to Waspaloy and Rene 95 alloy (a product of the General Electric Company). As illustrated in FIG. 2, for an 80 ksi operating stress, CMBA-7 alloy provides approximately 57° F. greater metal temperature capability than Rene 95 alloy. Furthermore, comparison to Waspaloy at 60 ksi indicates that the CMBA-7 alloy provides an additional approximate 64° F. capability.

Figure 3:
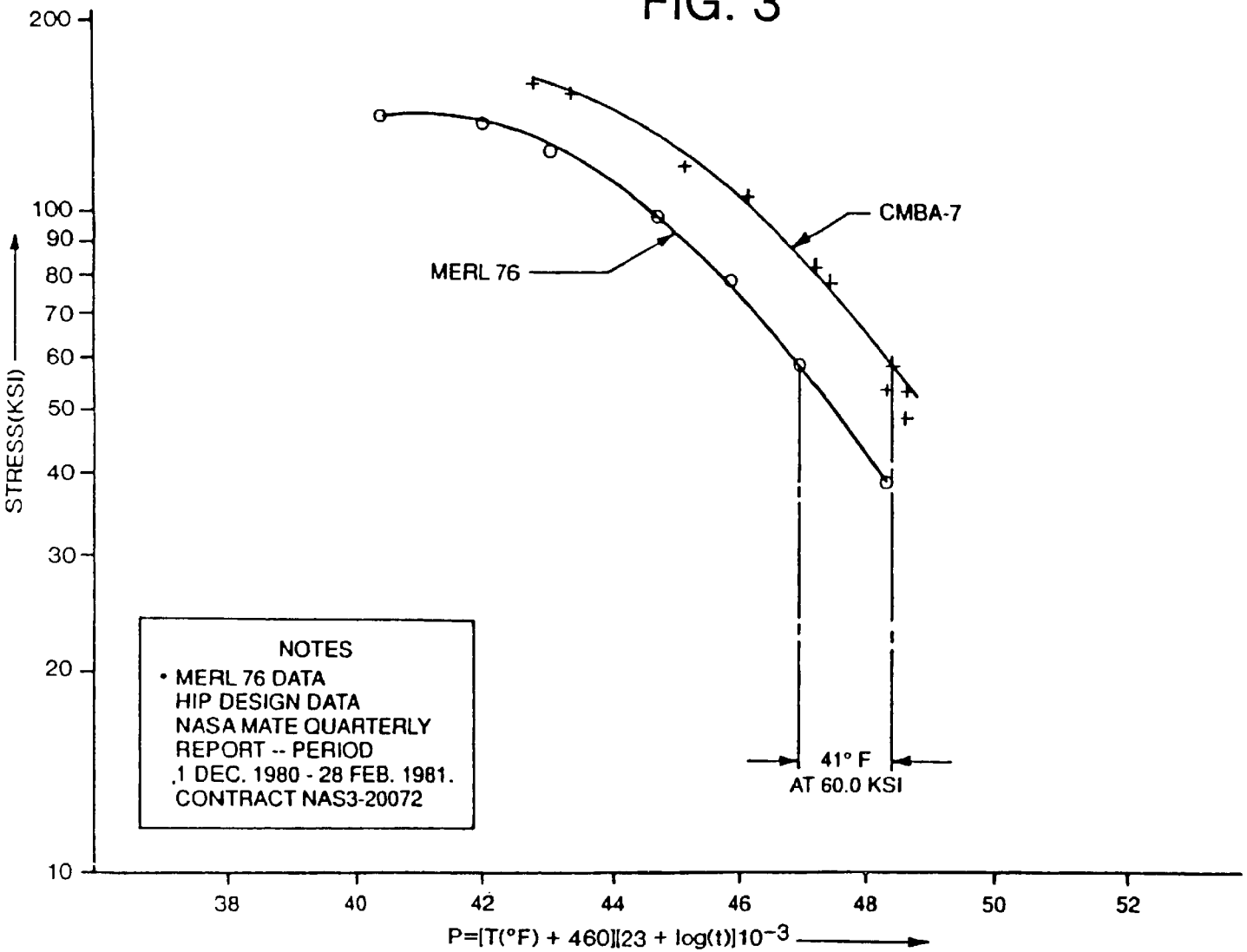
FIG. 3 is a Larson Miller stress-rupture plot comparing results from CMBA-7 alloy samples of the present invention to those of prior art MERL 76 alloy.

Similarly, FIG. 3 is a Larson Miller stress-rupture plot comparing the CMBA-7 alloy's rupture strength to the MERL 76 alloy (a product of the United Technologies Corporation). The Figure illustrates that for a 60 ksi stress level, the CMBA-7 alloy provides an approximate 41° F. metal temperature advantage relative to MERL 76 alloy.

Bar samples (0.375" diameter×3" long) of CMBA-6 and CMBA-7 alloys have been exposed to a 5% salt fog environment per ASTM B117 for approximately 4 years with no visible signs of corrosion.

Figure 4:
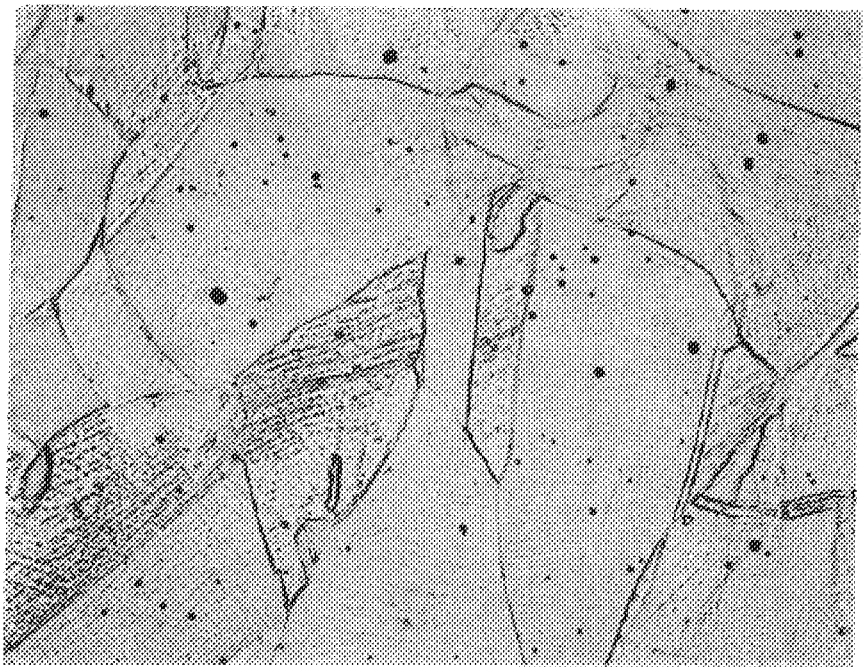
FIG. 4 is a photomicrograph (Etchant: 150 cc HCl+100 cc ethyl alcohol+13 gms cupric chloride) at 400X magnification of sample CMBA-6 of the present invention, which has a fully worked and aged bar microstructure that has been hot extruded, hot rolled, cold swaged and aged 10 hours at 1325° F.
Figure 5:
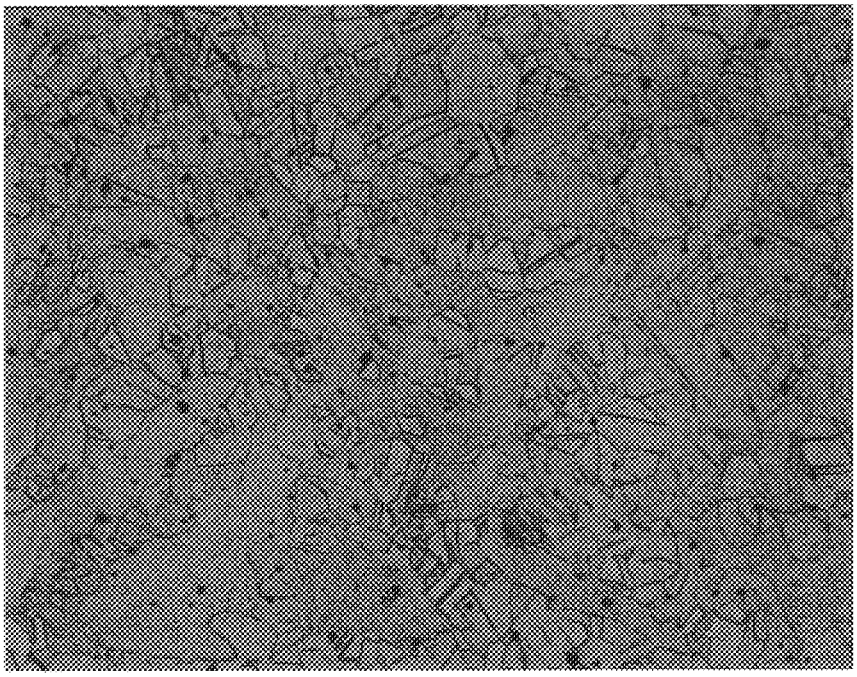
FIG. 5 is a photomicrograph (Etchant: 150 cc HCl+100 cc ethyl alcohol+13 gms cupric chloride) at 400X magnification of sample CMBA-7 of the present invention, which has a fully worked and aged bar microstructure that has been hot extruded, hot rolled, cold swaged and aged 10 hours at 1325° F.
Figure 6:
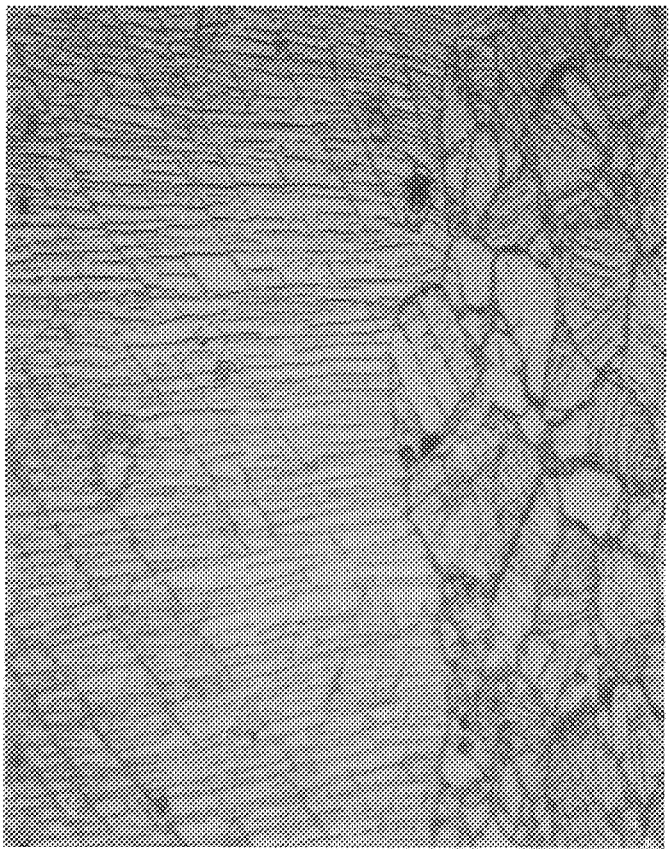
FIG. 6 is a photomicrograph (Etchant: 150 cc HCl+100 cc ethyl alcohol+13 gms cupric chloride) at 1000X magnification of a creep-rupture specimen microstructure of a CMBA-7 sample of the present invention, produced under 1400° F./60.0 ksi test condition with a rupture life of 994.4 hours.

Photomicrographs of CMBA-6 and CMBA-7 alloy samples, which were prepared with an optical metallograph, are presented in FIGS. 4–6. Also, scanning electron microscope generated micrographs of CMBA-7 alloy samples are presented in FIGS. 7 and 8. FIG. 4 is a photomicrograph at 400X magnification of a CMBA-6 sample of the present invention, which has a fully worked and aged bar microstructure that has been hot extruded, hot rolled, cold swaged and aged 10 hours at 1325° F. FIG. 5 is a photomicrograph at 400X magnification of a CMBA-7 sample of the present invention, which has a fully worked and aged bar microstructure that has been hot extruded, hot rolled, cold swaged and aged 10 hours at 1325° F.

Figure 7:
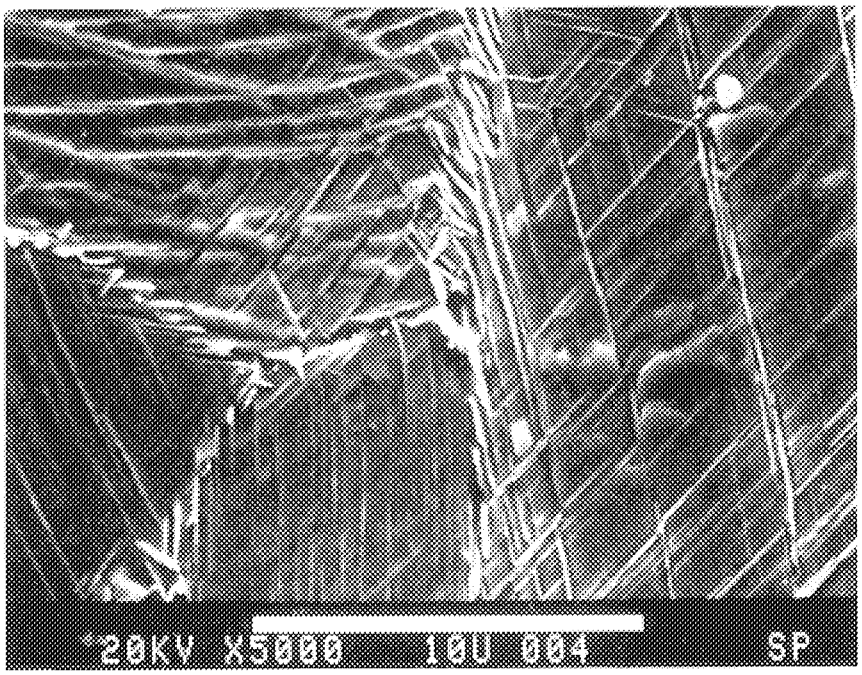
FIG. 7 is a scanning electron photomicrograph (Etchant: 150 cc HCl+100 cc ethyl alcohol+13 gms cupric chloride) at 5000X magnification of the fracture section of a creep-rupture specimen of a CMBA-7 sample of the present invention, produced under 1400° F./60.0 ksi test condition with a rupture life of 994.4 hours.
Figure 8:
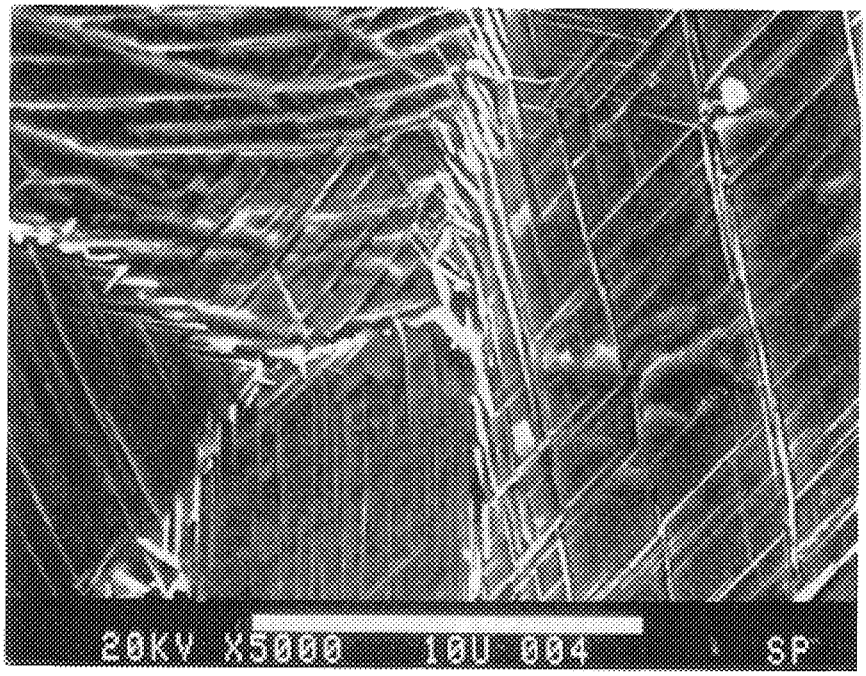
FIG. 8 is a scanning electron photomicrograph (Etchant: 150 cc HCl+100 cc ethyl alcohol+13 gms cupric chloride) at 10,000X magnification of the fracture section of a creep-rupture specimen of a CMBA-7 sample of the present invention, produced under 1400° F./60.0 ksi test condition with a rupture life of 994.4 hours.

FIG. 6 is a photomicrograph at 1000X magnification of a creep-rupture specimen microstructure of a CMBA-7 sample of the present invention, produced under 1400° F./60.0 ksi test condition with a rupture life of 994.4 hours. FIG. 7 is a scanning electron photomicrograph at 5000X magnification of the fracture section of a creep-rupture specimen of a CMBA-7 sample of the present invention, produced under 1400° F./60.0 ksi test condition with a rupture life of 994.4 hours. FIG. 8 is a scanning electron photomicrograph at 10,000X magnification of the fracture section of a creep-rupture specimen of a CMBA-7 sample of the present invention, produced under 1400° F./60.0 ksi test condition with a rupture life of 994.4 hours.

EXAMPLE 2

3" diameter and larger diameter VIM product was produced utilizing both laboratory and production-type processes. Table 6 below presents the chemistry of the CMBA-6 heats produced in both process types. Similarly, Table 7 below details the chemistry analyses for nine CMBA-7 VIM heats produced, while Table 8 below presents the chemistry detail for eight CMBA-8 VIM heats produced.

TABLE 6

CMBA-6 ALLOY HEAT CHEMISTRIES

| Element | Heat No. AE 5 | Heat No. AE 28 | Heat No. VF 687 | Heat No. VF 726 | Heat No. VF 738 | Heat No. VF 755 | Heat No. VF 790 | Heat No. VV 584 |
|---|---|---|---|---|---|---|---|---|
| C | .012 | .014 | .013 | .016 | .014 | .014 | .014 | .013 |
| Si | .013 | .014 | .014 | <.02 | <.03 | <.03 | .015 | <.02 |
| Mn | .002 | <.03 | .001 | <.02 | <.03 | <.03 | .001 | <.01 |
| S ppm | 5 | 9 | 6 | 10 | 6 | 5 | 5 | 12 |
| Cr | 17.3 | 17.3 | 17.3 | 16.9 | 17.1 | 17.0 | 16.8 | 16.9 |
| Co | 25.4 | 25.2 | 24.9 | 24.9 | 25.0 | 25.0 | 24.9 | 25.0 |
| Mo | 3.2 | 3.1 | 3.0 | 3.0 | 3.0 | 3.0 | 3.0 | 3.0 |
| W | 2.0 | 2.0 | 2.0 | 2.0 | 2.0 | 2.0 | 2.0 | 2.0 |
| Ta | 3.9 | 3.9 | 4.0 | 4.0 | 4.0 | 4.0 | 4.0 | 4.0 |
| Cb | 1.2 | 1.16 | 1.15 | 1.14 | 1.11 | 1.12 | 1.1 | 1.1 |
| Al | 1.00 | 1.01 | 1.03 | 1.03 | 1.01 | 1.08 | .99 | 1.07 |
| Ti | 2.06 | 2.0 | 2.02 | 2.08 | 2.06 | 2.17 | 2.19 | 2.13 |
| Zr | <.001 | <.001 | <.001 | <.003 | <.005 | <.010 | <.002 | <.005 |
| B | .018 | .020 | .023 | .014 | .018 | .013 | .015 | .018 |
| Fe | .04 | .03 | .029 | <.03 | <.05 | .09 | .05 | .049 |
| Cu | <.01 | <.05 | <.001 | <.02 | <.01 | <.02 | <.005 | <.005 |
| Ni | BAL | BAL | BAL | BAL | BAL | BAL | BAL | BAL |
| V | — | — | <.005 | <.05 | <.02 | <.05 | <.005 | <.005 |
| P | <.005 | <.005 | <.015 | <.015 | <.015 | <.015 | <.015 | <.015 |
| [N] ppm | 4 | 8 | 2 | 6 | 17 | 4 | 4 | 3 |
| [O] ppm | 6 | 18 | 2 | 4 | 3 | 4 | 3 | 1 |
| Pb ppm | — | — | <.5 | <.5 | <1 | <.5 | <.5 | <.5 |
| Ag ppm | — | — | <.2 | <.2 | <.2 | <.2 | <.2 | <.2 |
| Bi ppm | — | — | <.2 | <.2 | <.2 | <.2 | <.2 | <.2 |
| Se ppm | — | — | <.5 | <.5 | <.5 | <.5 | <.5 | <.5 |
| Te ppm | — | — | <.2 | <.2 | <.2 | <.2 | <.2 | <.2 |
| Tl ppm | — | — | <.2 | <.2 | <.2 | <.2 | <.2 | <.2 |
| Sn ppm | — | — | <5 | <5 | <5 | <5 | <5 | <5 |
| Sb ppm | — | — | <1 | <1 | <1 | <1 | <1 | <1 |
| As ppm | — | — | <1 | <1 | <1 | <1 | <1 | <1 |
| Zn ppm | — | — | <1 | <1 | <1 | <3 | <2 | <1 |
| Nv3B (PWA N-35) | 2.27 | 2.26 | 2.26 | 2.24 | 2.24 | 2.27 | 2.24 | 2.25 |

TABLE 7

CMBA-7 ALLOY HEAT CHEMISTRIES

| Element | Heat No. AE 6 | Heat No. AE 29 | Heat No. VF 688 | Heat No. VF 727 | Heat No. VF 739 | Heat No. VF 756 | Heat No. VF 791 | Heat No. VF 803 | Heat No. VF 926 |
|---|---|---|---|---|---|---|---|---|---|
| C | .010 | .016 | .015 | .013 | .011 | .014 | 010 | .014 | .013 |
| Si | .013 | .011 | .010 | <.02 | <.03 | <.03 | <.03 | <.03 | <.02 |
| Mn | .002 | <.03 | .001 | <.02 | <.03 | <.03 | <.02 | <.03 | <.02 |
| S ppm | 5 | 8 | 7 | 8 | 6 | 7 | 7 | 4 | 7 |
| Cr | 17.0 | 17.2 | 17.2 | 16.7 | 16.9 | 17.1 | 16.8 | 16.9 | 16.8 |
| Co | 29.6 | 29.8 | 29.9 | 30.4 | 30.1 | 30.2 | 29.7 | 30.1 | 30.0 |
| Mo | 3.5 | 3.5 | 3.5 | 3.4 | 3.5 | 3.5 | 3.5 | 3.4 | 3.5 |
| W | 2.0 | 2.0 | 2.0 | 2.0 | 2.0 | 2.0 | 2.0 | 2.0 | 2.0 |
| Ta | 4.0 | 4.0 | 4.0 | 4.0 | 4.0 | 4.0 | 4.0 | 4.0 | 4.0 |
| Cb | 1.2 | 1.2 | 1.22 | 1.17 | 1.15 | 1.15 | 1.14 | 1.15 | 1.17 |
| Al | .99 | 1.01 | 1.03 | 1.04 | 1.00 | 1.06 | 1.02 | 1.06 | 1.04 |
| Ti | 3.00 | 2.97 | 2.99 | 3.00 | 2.97 | 3.09 | 3.09 | 3.12 | 3.10 |
| Zr | <.001 | <.001 | <.001 | <.01 | <.005 | <.01 | <.01 | <.01 | <.01 |
| B | .016 | .017 | .021 | .019 | .014 | .020 | .019 | .017 | .018 |
| Fe | .04 | .04 | .02 | <.05 | <.05 | <.10 | <.10 | <.10 | .05 |
| Cu | <.01 | <.05 | <.001 | <.01 | <.01 | <.01 | <.01 | <.01 | <.01 |
| Ni | BAL | BAL | BAL | BAL | BAL | BAL | BAL | BAL | BAL |
| V | — | — | <.005 | <.05 | <.01 | <.05 | <.05 | <.01 | <.05 |
| P | <.005 | <.005 | <.015 | <.015 | <.015 | <.015 | <.015 | <.015 | <.015 |
| [N] ppm | 5 | 6 | 3 | 7 | 12 | 5 | 5 | 40 | 21 |
| [O] ppm | 4 | 27 | 4 | 5 | 5 | 4 | 6 | 1 | 3 |
| Pb ppm | — | — | <.5 | <.5 | <1 | <.5 | <.5 | <.5 | <.5 |
| Ag ppm | — | — | <.2 | <.2 | <.2 | <.2 | <.2 | <.2 | <.2 |
| Bi ppm | — | — | <.2 | <.2 | <.2 | <.2 | <.2 | <.2 | <.2 |
| Se ppm | — | — | <.5 | <.5 | <.5 | <.5 | <.5 | <.5 | <.5 |
| Te ppm | — | — | <.2 | <.2 | <.2 | <.2 | <.2 | <.2 | <.2 |
| Tl ppm | — | — | <.2 | <.2 | <.2 | <.2 | <.2 | <.2 | <.2 |

TABLE 7-continued

CMBA-7 ALLOY HEAT CHEMISTRIES

| Element | Heat No. AE 6 | Heat No. AE 29 | Heat No. VF 688 | Heat No. VF 727 | Heat No. VF 739 | Heat No. VF 756 | Heat No. VF 791 | Heat No. VF 803 | Heat No. VF 926 |
|---|---|---|---|---|---|---|---|---|---|
| Sn ppm | — | — | <5 | <5 | <5 | <5 | <5 | <5 | <5 |
| Sb ppm | — | — | <1 | <1 | <1 | <1 | <1 | <1 | <1 |
| As ppm | — | — | <1 | <1 | <1 | <1 | <1 | <1 | <1 |
| Zn ppm | — | — | <1 | <2 | <1 | <2 | <1 | <1 | <1 |
| Nv3B (PWA N-35) | 2.46 | 2.47 | 2.48 | 2.45 | 2.45 | 2.50 | 2.46 | 2.48 | 2.47 |

TABLE 8

CMBA-8 ALLOY HEAT CHEMISTRIES

| Element | Heat No. AE 7 | Heat No. AE 30 | Heat No. AE 31 | Heat No. VF 692 | Heat No. VF 728 | Heat No. VF 740 | Heat No. VF 757 | Heat No. VF 792 |
|---|---|---|---|---|---|---|---|---|
| C | .011 | .014 | .014 | .014 | .013 | .014 | .013 | .015 |
| Si | .008 | .011 | .011 | .009 | <.02 | <.02 | <.03 | <.03 |
| Mn | .002 | <.03 | <.03 | .002 | <.02 | <.02 | <.03 | <.02 |
| S ppm | 5 | 8 | 8 | 5 | 6 | 6 | 6 | 7 |
| Cr | 14.4 | 14.5 | 14.4 | 14.4 | 14.3 | 14.4 | 14.4 | 14.3 |
| Co | 32.7 | 32.8 | 32.8 | 32.9 | 32.9 | 32.9 | 33.0 | 32.9 |
| Mo | 3.5 | 3.5 | 3.5 | 3.5 | 3.6 | 3.6 | 3.5 | 3.5 |
| W | 2.4 | 2.4 | 2.4 | 2.6 | 2.5 | 2.4 | 2.5 | 2.5 |
| Ta | 4.4 | 4.46 | 4.47 | 4.5 | 4.5 | 4.5 | 4.4 | 4.5 |
| Cb | 1.1 | 1.1 | 1.11 | 1.10 | 1.13 | 1.13 | 1.13 | 1.13 |
| Al | .95 | .97 | .96 | .99 | 1.03 | .99 | 1.06 | 1.05 |
| Ti | 3.68 | 3.64 | 3.65 | 3.64 | 3.69 | 3.67 | 3.73 | 3.75 |
| Zr | <.001 | <.001 | <.001 | <.001 | <.005 | <.005 | <.02 | <.02 |
| B | .014 | .014 | .013 | .016 | .017 | .017 | .018 | .018 |
| Fe | .04 | .04 | .04 | .03 | <.05 | <.10 | <.10 | .03 |
| Cu | <.01 | <.05 | <.05 | <.001 | <.01 | <.01 | <.01 | <.01 |
| Ni | BAL | BAL | BAL | BAL | BAL | BAL | BAL | BAL |
| V | — | — | — | <.005 | <.05 | <.05 | <.05 | <.03 |
| P | <.005 | <.005 | <.005 | <.015 | <.015 | <.005 | <.005 | <.015 |
| [N] ppm | 5 | 4 | 6 | 2 | 2 | 2 | 4 | 5 |
| [O] ppm | 6 | 18 | 17 | 2 | 6 | 7 | 5 | 6 |
| Pb ppm | — | — | — | <.5 | <.5 | <1 | <.5 | <.5 |
| Ag ppm | — | — | — | <.2 | <.2 | <.2 | <.2 | <.2 |
| Bi ppm | — | — | — | <.2 | <.2 | <.2 | <.2 | <.2 |
| Se ppm | — | — | — | <.5 | <.5 | <.5 | <.5 | <.5 |
| Te ppm | — | — | — | <.2 | <.2 | <.2 | <.2 | <.2 |
| Tl ppm | — | — | — | <.2 | <.2 | <.2 | <.2 | <.2 |
| Sn ppm | — | — | — | <5 | <5 | <5 | <5 | <5 |
| Sb ppm | — | — | — | <1 | <1 | <1 | <1 | <1 |
| As ppm | — | — | — | <1 | <1 | <1 | <1 | <1 |
| Zn ppm | — | — | — | <2 | <2 | <1 | <3 | <1 |
| Nv3B (PWA N-35) | 2.44 | 2.45 | 2.45 | 2.46 | 2.48 | 2.47 | 2.49 | 2.48 |

35 lb. samples of the CMBA-6 and CMBA-7 alloys were VIM processed to a 3¾" diameter×7" long dimension. Samples were homogenize-annealed using a cycle of 10 hours at 2125° F.+40 hours at 2150° F. The ingots were canned in 304 stainless steel and extruded to 1½" diameter at approximately 2100° F. After surface conditioning, the extrusions were hot rolled at about 2050° F. to a 0.466" diameter bar. Each alloy type was split into two lots. One lot of each alloy was solution treated at 2050° F. for 4 hours, aged at 1562° F. for 10 hours/AC, and then cold drawn to 0.390" diameter for a 30% reduction. The remaining alloy lots were further hot rolled at about 2050° F. to 0.423" diameter, solution treated at 2050° F. for 4 hours, aged at 1562° F. for 10 hours/AC and then cold drawn to $_{0.390}$" diameter (15% reduction). All lots were given a final age at 1325° F. for 10 hours/AC. Smooth specimens (0.252" diameter) and threaded studs (5/16–24×1.5)- were fabricated for testing. Specimen tensile tests were conducted per ASTM E8 and E21 methods, while stud samples were tested in accordance to MIL-STD-1312 test numbers 8 and 18. The test results are presented in Table 9 below.

TABLE 9

CMBA-6 AND CMBA-7 TENSILE DATA

| Test Condition | CMBA-6 (Heats AE 28 & VF 738) 15%** Cold Work | | | CMBA-6 (Heats AE 28 & VF 738) 30% Cold Work | | | CMBA-7 (Heat VF 739) 15% Cold Work | CMBA-7 (Heat VF 739) 30% Cold Work | |
|---|---|---|---|---|---|---|---|---|---|
| Smooth Specimens | | | | | | | | | |
| A. Room Temperature | | | | | | | | | |
| UTS, ksi | 219.1 | 216.7 | | 258.3 | 260.4 | 258.4 | 221.1 | 262.7 | |
| 0.2% YS, ksi | 198.8 | 194.8 | | 249.3 | 250.5 | 247.3 | 201.6 | 254.4 | |
| Elong., % | 11.0 | 11.0 | | 5.0 | 3.0 | 3.0 | 10.0 | 4.0 | |
| RA, % | 20.8 | 19.4 | | 9.4 | 8.5 | 9.3 | 19.5 | 10.0 | |
| B. 1250° F. | | | | | | | | | |
| UTS, ksi | | 182.6 | | 212.4 | | | 186.9 | 215.3 | |
| 0.2% YS, ksi | | 160.4 | | 199.2 | | | 160.4 | 200.6 | |
| Elong., % | | 5.2 | | 3.0 | | | 6.0 | 6.0 | |
| RA, % | | 7.7 | | 10.0 | | | 7.0 | 8.4 | |
| C. 1350° F. | | | | | | | | | |
| UTS, ksi | 175.6 | 174.2 | 173.0 | 199.3 | 195.8 | 181.0 | | 190.8 | 198.1 |
| 0.2% YS, ksi | 160.5 | 146.8 | 159.3 | 166.5 | 157.8 | 161.0 | | | 166.5 |
| Elong., % | 4.0 | 5.0 | 9.0 | 7.0 | 9.0 | 9.0 | | 4.0 | 8.0 |
| RA, % | 8.4 | 7.8 | 11.5 | 19.5 | 17.5 | 16.0 | | 8.5 | 14.4 |
| Threaded Studs | | | | | | | | | |
| A. Room Temperature | | | | | | | | | |
| UTS, ksi | | | 212.6 | 231.4 | 230.5 | | | | |
| B. 1250° F. | | | | | | | | | |
| UTS, ksi | | | 176.2 | | | | | | |
| | | | 175.9 | | | | | | |
| C. 1350° F. | | | | | | | | | |
| UTS, ksi | | | 169.5 | 186.0 | 198.0 | | | | |

Notes:
Test Articles: .252" diameter smooth specimens and 5/16 – 24 × 1.5 threaded studs.
Condition: Solutioned + aged 1562° F./10 hours/AC + cold worked as indicated + aged 1325° F./10 hours/AC.
Stress for studs based on area at the basic pitch diameter (.06397 in.$^2$).
**Also exhibited a RT double shear strength of 133.7 ksi.

Specimen stress-rupture tests were performed in accordance with ASTM E139 while stud tests were undertaken in accordance with MIL-STD-1312, test number 10. The results of such tests are presented in Table 10 below.

TABLE 10

CMBA-6 AND CMBA-7 STRESS-RUPTURE DATA

| Test Condition | Stress Rupture Life, hours: CMBA-6 (Heats AE 28 & VF 738) 15% Cold Work | CMBA-6 (Heats AE 28 & VF 738) 30% Cold Work | CMBA-7 (Heat VF 739) 15% Cold Work | CMBA-7 (Heat VF 739) 30% Cold Work |
|---|---|---|---|---|
| A. Specimens | | | | |
| 1350° F./93.2 ksi | 0.8 | 385.7 | 162.3 | 300.9 |
| | 56.8 | 300.0† | | 265.5 |
| | 136.6 | 381.1 | | |
| | | 390.5 | | |
| 1350° F./68.2 ksi | 1014.0† | 1103.7† | 1004.5† | 1031.2† |
| | 1003.6† | 390.5 | | |

TABLE 10-continued

CMBA-6 AND CMBA-7 STRESS-RUPTURE DATA

| | Stress Rupture Life, hours | | | |
|---|---|---|---|---|
| | CMBA-6 (Heats AE 28 & VF 738) | | CMBA-7 (Heat VF 739) | |
| Test Condition | 15% Cold Work | 30% Cold Work | 15% Cold Work | 30% Cold Work |
| B. Studs | | | | |
| 1350° F./93.2 ksi | 55.6 | 167.6 | — | — |
| | 35.9 | | | |
| | 38.5 | | | |
| | 64.6 | | | |
| 1350° F./68.2 ksi | 1709.2 | 1344.2 | 1103.7† | — |
| | 1174.9† | 1646.5 | | |
| | 1413.0 | | | |
| | 1003.6† | | | |

Notes:
Test Article: .252" diameter specimens and 5/16 – 24 × 1.5 studs.
Condition: Solutioned + aged 1562° F./10 hours/AC + cold worked as indicated + aged 1325° F./10 hours/AC.
Stress for studs based on area at the basic pitch diameter (0.06397 in.$^2$).
"†" denotes that the test was terminated prior to failure.

The stress-rupture test results presented in Table 10 indicate that the materials exhibit relatively high strength.

Tension impact tests were performed with stud samples. The test apparatus employed was the type described in ASTM E23. However, instead of testing notched, rectangular bars, the test utilized threaded fixtures and adaptors which permitted the testing of threaded samples. The apparatus applied an impact load along the longitudinal axis of the respective test pieces, and the energy absorbed by the respective test piece prior to fracture was measured. The results are presented in Table 11 below.

TABLE 11

CMBA-6 AND CMBA-7 TENSION-IMPACT DATA

| | Tension-Impact Strength, ft.-lbs. | | |
|---|---|---|---|
| | CMBA-6 (Heats VF 738 & AE 28) | | CMBA-7 (Heat VF 739) |
| Test Condition | 15% Cold Work | 30% Cold Work | 15% Cold Work |
| Pre-Exposure | 89.7 | 66.7 | 100.0 |
| Post-Exposure* | 29.5 | 27.0 | 37.0 |

Notes:
*Test Article: 5/16–24 × 1.5 studs.
*Condition: Solutioned + aged 1562° F./10 hours/AC + cold worked as indicated + aged 1325° F./10 hours/AC.
*Results presented are averaged values.
*Stress based on area at the basic pitch diameter (0.06397 in.$^2$).
*1350° F./40 ksi/100 hours.

Larger diameter CMBA-6, CMBA-7 and CMBA-8 VIM material was processed for hot extrusion and hot rolling reduction, but the effort was not pursued past the hot extrusion reduction since some ingot cracking was experienced.

EXAMPLE 3

The materials produced for this example were made in accordance with the aim chemistries indicated in Table 1, except that respective Al and Ti additions were slightly increased due to their expected partial loss during the ESR remelting operation. Three-inch diameter VIM ingot samples (Heats VF 755 and VF 757) were ESR processed into four-inch diameter, 50 pound and VF 757) were ESR processed into four-inch diameter, 50 pound ingots. A 67-10-10-10-3 slag formulation (67CaF, 10CaO, 10MgO, $10Al_2O_3$, $3TiO_2$) was utilized, and it is believed that the alloy chemistries were maintained adequately during the ESR process, although modest silicon and nitrogen pick-up were noted.

All test materials were homogenized as follows:

| | |
|---|---|
| CMBA-6 | 2125° F./4 Hrs. +2150° F./65 Hrs./AC |
| CMBA-7, -8 | 2150° F./4 Hrs. +2200° F./65 Hrs./AC |

These materials were then press forged into three-inch square ingots at 2100°–2150° F. The CMBA-6 and CMBA-8 samples were successfully forged further to 1–1/4 inch thick slabs, while the CMBA-7 samples cracked.

The CMBA-6 and CMBA-8 specimens exhibited minor edge cracking during the subsequent hot rolling reduction to 1/8 inch thickness at 2050–2100° F. Several re-heats were necessary to complete the desired reduction. The materials were cold rolled to reduction ranging 5–15%, and subsequently aged for 20 hours at 1325° F./AC.

CMBA-6 and CMBA-8 tensile, stress-rupture and creep-rupture test samples were prepared and tested according to standard ASTM procedures.

Tensile tests were performed on CMBA-6 sheet specimens which were 15% cold rolled. Average transverse tensile properties were measured at room temperature (RT), 900° F., 1100° F., 1200° F., and 1300° F. The tensile 0.2% yield strength, ultimate tensile strength and percent elongation were measured for these samples. The results are presented in Table 12 below.

TABLE 12

CMBA-6 (Heat VF 755) AVERAGE TRANSVERSE TENSILE DATA SHEET SPECIMENS; 15% COLD WORK

| Test Temp (°F./°C.) | 0.2% Yield (KSI) | UTS (KSI) | ELONG (%) |
|---|---|---|---|
| RT | 190.4 | 216.1 | 18.0 |
| 900/482 | 173.9 | 186.8 | 13.7 |
| 1100/593 | 162.4 | 180.6 | 14.0 |
| 1200/649 | 162.9 | 179.0 | 10.8 |
| 1300/704 | 154.2 | 157.5 | 5.6 |

Table 13, presented below, shows longitudinal tensile property test results for CMBA-6 specimens which were 15% cold rolled. The tensile 0.2% yield strength, ultimate tensile strength, and percent elongation were measured for the CMBA-6 samples at room temperature (RT), 900° F., 1100° F., 1200° F., and 1300° F. The 15% cold rolled CMBA-6 test results are compared with the commercially reported Waspaloy tensile properties.

TABLE 13

LONGITUDINAL TENSILE DATA COMPARISON CMBA-6 (Heat VF 755) vs. WASPALOY

| Test Temp (°F./°C.) | Alloy | 0.2% Yield (KSI) | UTS (KSI) | ELONG (%) | RA (%) |
|---|---|---|---|---|---|
| RT | WASPALOY | 130.0 | 190.0 | 22.0 | 25.0 |
| | CMBA-6 | 185.1 | 209.0 | 21.4 | — |
| 900/482 | CMBA-6 | 167.3 | 178.4 | 16.4 | — |
| 1100/593 | WASPALOY | 117.5* | 177.5* | 18.5* | 27.5* |
| | CMBA-6 | 158.4 | 171.0 | 15.8 | — |
| 1200/649 | WASPALOY | 115.0 | 175.0 | 15.0 | 30.0 |
| | CMBA-6 | 154.5 | 167.0 | 13.9 | — |
| 1300/704 | WASPALOY | 112.5** | 152.5** | 21.0** | 40.0** |
| | CMBA-6 | 148.4 | 151.0 | 5.7 | — |

Notes:
*CMBA 6 -- (Heat VF 755) -- 15% Cold Worked Sheet Specimens
*WASPALOY -- Forged and Fully Heat Treated to Rockwell C38 (Method "B"); Source: Engineering Alloys Digest, Inc., Upper Montclair, New Jersey.
*Averege result calculated from 1000° F. and 1200° reported values.
**Averege result calculated from 1200° F. and 1400° F. reported values.

Table 14, presented below, shows results of transverse sheet specimen tensile tests undertaken with CMBA-8 materials which were cold rolled to 5% and 15% levels. Average transverse tensile properties are presented for room temperature (RT), 700° F., 900° F., 1100° F., 1200° F., 1300° F., and 1400° F. tests.

TABLE 14

CMBA-8 (Heat VF 757) AVERAGE TRANSVERSE TENSILE DATA SHEET SPECIMENS; 5%, 15% COLD WORK

| Test Temp (°F./°C.) | % Cold Work | 0.25 Yield (KSI) | UTS (KSI) | ELONG (%) |
|---|---|---|---|---|
| RT | 5 | 162.9 | 218.3 | 25.3 |
| | 15 | 215.6 | 250.2 | 7.7 |
| 700/371 | 5 | 144.9 | 188.4 | 22.1 |
| | 15 | 199.9 | 223.0 | 8.6 |
| 900/482 | 5 | 149.2 | 184.5 | 22.0 |
| | 15 | 195.8 | 216.2 | 7.2 |
| 1100/593 | 5 | 141.9 | 176.2 | 11.2 |
| | 15 | 187.8 | 205.6 | 5.6 |
| 1200/649 | 5 | 139.4 | 158.5 | 11.2 |
| | 15 | 186.1 | 189.8 | 2.4 |
| 1300/704 | 5 | 126.2 | 146.2 | 11.1 |
| | 15 | 158.8 | 158.8 | 4.8 |
| 1400/760 | 5 | 115.1 | 115.1 | 5.8 |
| | 15 | 99.6 | 99.6 | 2.2 |

Table 15, presented below, shows average longitudinal tensile property test results obtained for CMBA-8 sheet specimens , which were 5% and 15% cold rolled.

TABLE 15

CMBA-8 (Heat VF 757) AVERAGE LONGITUDINAL TENSILE DATA SHEET SPECIMENS; 5%, 15% COLD WORK

| Test Temp (°F./°C.) | % Cold Work | 0.2% Yield (KSI) | UTS (KSI) | ELONG (%) |
|---|---|---|---|---|
| RT | 5 | 158.9 | 215.2 | 26.7 |
| | 15 | 216.4 | 237.4 | 8.4 |
| 500/260 | 5 | 145.2 | 191.9 | 25.6 |
| | 15 | 209.8 | 230.6 | 8.4 |
| 700/371 | 5 | 144.8 | 185.2 | 25.7 |
| | 15 | 202.0 | 220.5 | 8.4 |
| 900/482 | 5 | 144.1 | 182.1 | 24.5 |
| | 15 | 198.9 | 216.0 | 8.7 |
| 1100/593 | 5 | 137.4 | 168.9 | 21.2 |
| | 15 | 197.3 | 210.1 | 8.2 |
| 1200/649 | 5 | 136.8 | 157.0 | 16.4 |
| | 15 | 190.8 | 193.9 | 4.5 |
| 1300/704 | 5 | 130.8 | 131.8 | 8.3 |
| | 15 | 160.8 | 170.3 | 3.1 |
| 1400/760 | 5 | 100.0 | 100.0 | 5.6 |
| | 15 | 101.6 | 110.6 | 2.6 |

Elevated temperature longitudinal and transverse creep-rupture tests were also conducted with CMBA-6 and CMBA-8 sheet samples. The results for tests conducted between 1200° F. to 1500° F. are presented in Table 16 below. The tests were undertaken with CMBA-6 samples which were 15% cold rolled, while the CMBA-8 alloy was evaluated at both 5% and 15% levels.

TABLE 16

CMBA-6 (Heat VF 755) AND CMBA-8 (Heat VF 757) SHEET PRODUCT CREEP-RUPTURE DATA

| Test Condition | Alloy | Rupture Time Hours | EL % | Final Creep Reading t, Hours | Final Creep Reading % Deformation | Time in Hours to Reach 1.0% | Time in Hours to Reach 2.0% |
|---|---|---|---|---|---|---|---|
| Longitudinal Data | | | | | | | |
| 1200° F./154.0 ksi | −8* | 220.6 | 2.1 | 218.3 | 0.514 | — | — |
| 1300° F./115.0 ksi | −8* | 355.9 | 6.3 | 354.8 | 3.998 | 249.4 | 323.2 |
| | −8* | 312.7 | 5.3 | 310.6 | 3.466 | 183.8 | 278.9 |
| 1350° F./84.0 ksi | −8* | 512.3 | 6.1 | 511.2 | 4.647 | 268.4 | 421.8 |
| | −8* | 623.5 | 10.5 | 623.3 | 9.732 | 146.6 | 407.8 |
| 1350° F./90.0 ksi | −8* | 149.7 | 14.9 | 148.2 | 11.154 | 90.1 | 131.2 |
| | −6 | 95.2 | 16.0 | 94.9 | 10.054 | 13.3 | 57.0 |
| 1400° F./60.0 ksi | −6 | 438.2 | 4.8 | 437.6 | 2.910 | 184.6 | 337.5 |
| | −8* | 1049.1 | 19.3 | 1048.8 | 16.766 | 219.4 | 554.7 |
| 1400° F./80.0 ksi | −8* | 178.6 | 13.6 | 178.4 | 3.128 | 78.5 | 151.9 |
| 1450° F./55.0 ksi | −6 | 221.4 | 6.0 | 221.0 | 5.531 | 125.7 | 178.9 |
| | −8* | 325.0 | 5.5 | 324.5 | 5.192 | 177.6 | 255.9 |
| | −8* | 353.0 | 15.8 | 352.6 | 13.152 | 183.6 | 250.8 |
| 1500° F./50.0 ksi | −8* | 149.7 | 14.9 | 148.2 | 11.154 | 90.1 | 131.2 |
| | −6 | 95.2 | 16.0 | 94.9 | 10.054 | 13.3 | 57.0 |
| Transverse Data | | | | | | | |
| 1350° F./75.0 ksi | −6 | 137.6 | 3.1 | 136.4 | 0.730 | — | — |
| 1400° F./60.0 ksi | −6 | 610.5 | 5.4 | 609.5 | 4.555 | 32.7 | 493.5 |
| | −8 | 495.4 | 2.7 | 492.0 | 1.868 | 420.2 | — |
| 1450° F./45.0 ksi | −6 | 642.8 | 11.0 | 642.5 | 9.363 | 343.1 | 487.9 |
| | −8 | 667.5 | 12.2 | 666.4 | 10.731 | 363.9 | 483.3 |
| 1500° F./40.0 ksi | −6 | 225.0 | 15.1 | 225.0 | 10.362 | 82.9 | 143.6 |
| | −8 | 278.0 | 15.0 | 276.8 | 12.056 | 142.0 | 193.2 |
| | −8* | 458.9 | 10.9 | 458.2 | 9.366 | 178.2 | 271.7 |

Notes:
CMBA-6 - 15% Cold Work.
CMBA-8 - 5% Cold Work.
CMBA-8* - 15% Cold Work.

A number of the creep specimens tested in this program failed when the specimens were loaded. However, it is believed that the failures were caused by unacceptably large grain sizes rather than being a consequence of alloy design. Accordingly, strict thermal cycle controls may be advantageous to providing the small grain size and grain boundary microstructures which are generally desired. Additionally, creative methods of hot working with intermediate anneal(s) prior to completion of hot working may be useful toward providing desired grain sizes.

Despite the specimens which failed on loading, encouraging rupture lives and ductilities were apparent for the alloys of this invention. The test results indicated that improved alloy ductility was possible with the 5–15% cold worked materials relative to 25% cold worked CMBA-6 and CMBA-7 materials, while retaining high strength.

EXAMPLE 4

Fifty pound samples of CMBA-6 (Heat VF790) were ESR processed into two 4" diameter ingots. The ingots were homogenize-annealed using a cycle of 2125° F. for 4 hours+ 2150° F. for 65 hours. The ingots were press forged to 2"×2" at about 2100° F.

One 2"×2" billet (Lot 1) was hot rolled to 0.562" diameter at about 2050° F. and split into four sublots. One sublot (NN) was further hot rolled to 0.447" diameter, solution treated at 2015° F. for 2 hours, and cold drawn to 0.390" diameter for a 24% reduction. A second sublot (RR) was hot rolled to 0.447" diameter, solution treated at 2015° F. for 2 hours, aged at 1562° F. for 10 hours/AC, and then cold drawn to 0.390" diameter (24% reduction). A third sublot (MM) was hot rolled to 0.436" diameter, solution treated at 2015° F. for 2 hours, aged at 1472° F. for 6 hours/AC, and then cold drawn to 0.390" diameter (20% reduction). The fourth sublot (PP) was hot rolled to 0.431" diameter, solution treated at 2015° F. for 2 hours, aged at 1562° F. for 10 hours/AC, and then cold drawn to 0.390" diameter (18% reduction). All four sublots were given a final age at 1350° F. for 4 hours/AC.

Threaded studs (⅜-24×1.5) were fabricated and tested. The results of such tests are presented in Table 17 below. The tensile tests were conducted per NIL-STD-1312, test numbers 8 and 18. Stress-rupture tests were conducted per MIL-STD-1312, test number 10. Tension-impact tests were conducted as described in Example 2 above.

TABLE 17

CMBA-6 TENSILE, STRESS-RUPTURE AND IMPACT STRENGTH DATA

| Property | CMBA-6 (Heat VF 790, Lot 1) Sublot MM | Sublot NN | Sublot PP | Sublot RR |
|---|---|---|---|---|
| Tensile Strength | | | | |
| RT UTS, ksi | 254.0 | 234.7 | 240.2 | 246.4 |
| RT YS, ksi | 222.2 | 207.8 | 203.8 | 219.4 |
| 1250° F. UTS, ksi | 213.0 | 192.6 | 195.9 | 207.8 |
| 1250° F. YS, ksi | 185.4 | 174.2 | 172.9 | 184.1 |

TABLE 17-continued

CMBA-6 TENSILE, STRESS-RUPTURE AND IMPACT STRENGTH DATA

| Property | CMBA-6 (Heat VF 790, Lot 1) Sublot MM | Sublot NN | Sublot PP | Sublot RR |
|---|---|---|---|---|
| Stress Rupture Life, hrs. | | | | |
| 1300° F./100 ksi | 106 | 324 | 431 | 215 |
| Tension Impact Strength, ft. – lbs. | | | | |
| Pre-exposure | 125 | 214 | 140 | 133 |
| Post-exposure* | 62 | 207 | 116 | 51 |

Notes:
Test Specimen Type: ⅜ – 24 × 1.5 studs.
All specimens solutioned for 2 hours at 2015° F., prior to aging and cold work processing.
MM - 1475° F./6 hrs./AC + 20% cold work + 1350° F./4 hrs./AC.
NN - 24% cold work + 1350° F./4 hours.
PP - 1562° F./10 hrs./AC + 18% cold work + 1350° F./4 hrs./AC.
RR - 1562° F./10 hrs./AC + 24% cold work + 1350° F./4 hrs./AC.
Results presented are averaged values.
Stress based on area at the basic pitch diameter (0.09506 in.$^2$).
*1300° F./50 ksi/100 hours.

Additional materials were evaluated which were solution treated, 24% cold worked and aged at 1350° F./4 hours/AC (i.e., the processing method identified as NN in Table 17). Spline head bolts (⅜-24×1.270) and 0.252" diameter specimens were fabricated and tested. Tensile tests were conducted on the bolts per MIL-STD-1312, test number 8 and 18, and on the specimens per ASTM E8 and E21. Stress-rupture tests were performed on the bolts per MIL-STD-1312, test number 10. Thermal stability was evaluated by comparing the tension-impact strength and wedge tensile strength (ASTM F606) of bolts which had and had not received an elevated temperature, stressed exposure for a specific period of time. Cylindrical blanks (⅜" diameter×1" long) were machined from the drawn and aged bar, and double shear tested per MIL-STD-1312, test number 13. These test results are presented in Table 18 below.

TABLE 18

CMBA-6 TENSILE, STRESS-RUPTURE, IMPACT AND WEDGE TENSILE STRENGTH DATA

| Property | | CMBA-6 Alloy (Heat VF 790, Lot 1) |
|---|---|---|
| A. BOLTS | | |
| RT Tensile | UTS, ksi | 233.5 |
| | YS, ksi | 208.3 |
| 1250° F. Tensile | UTS, ksi | 187.0 |
| | YS, ksi | 167.3 |
| 1300° F. Tensile | UTS, ksi | 185.0 |
| | YS, ksi | 165.7 |
| 1300° F./100 ksi Stress-Rupture Life, hours | | 151.9 |
| Tension Impact Strength ft. – lbs. | | |
| Pre-exposure | | 243 |
| Post-exposure #1 | | 150 |
| Post-exposure #2 | | 121 |
| Tensile Strength, ksi | | |
| Pre-exposure | | 233.5 |
| Post-exposure #2 | | 222.9 |

TABLE 18-continued

CMBA-6 TENSILE, STRESS-RUPTURE, IMPACT AND WEDGE TENSILE STRENGTH DATA

| Property | | CMBA-6 Alloy (Heat VF 790, Lot 1) |
|---|---|---|
| 2° Wedge Tensile Strength, ksi | | |
| Pre-exposure | | 234.3 |
| Post-exposure #1 | | 218.3 |
| 4° Wedge Tensile Strength, ksi | | |
| Pre-exposure | | 230.3 |
| Post-exposure #1 | | 213.9 |
| B. SPECIMENS | | |
| RT Tensile | UTS, ksi | 230 |
| | 0.2% YS, ksi | 204 |
| | Elong., % | 17 |
| | RA, % | 40 |
| | Sheer Stress, ksi | 141.3 |

Notes:
Test Articles: ⅜ – 24 × 1.270 spline head bolts, .252" diameter specimens and 3/8" diameter × 1" pins.
Condition: Solutioned + 24% cold work + 1350° F./4 hours/AC.
Results presented are averaged values.
Stress for bolts based on area at the basic pitch diameter (0.09506 in.$^2$).
Exposure cycle #1: 1300° F./50 ksi/100 hours.
Exposure cycle #2: 1050° F./138 ksi/640 hours.

Creep tests were conducted per ASTM E139 on 0.252" diameter specimens. The times to 0.1% and 0.2% creep were measured. These test results are presented in Table 19 below.

TABLE 19

CMBA-6 (Heat VF 790, Lot 1) CREEP-RUPTURE DATA

| Test Conditions | Time to 0.1% Creep, hrs. | Time to 0.2% Creep, hrs. |
|---|---|---|
| 1200° F./90 ksi | 547.3 | 2192.3 |
| 1200° F./75 ksi | 459.1 | 1916.3 |
| 1200° F./65 ksi | 412.7 | 4285.6 |
| 1300° F./50 ksi | 185.3 | 995.4 |
| 1300° F./35 ksi | 611.5 | 4284.5 |

Notes:
*Test Article: .252" diameter specimens.
*Condition: Solutioned + 24% cold work + 1350° F./4 hours/AC.

The thermal expansion coefficient of CMBA-6 alloy was measured on 0.375" diameter×2" long specimens per ASTM E228. The test results are presented in Table 20 below.

TABLE 20

CMBA-6 (Heat VF 790, Lot 1)
THERMAL EXPANSION COEFFICIENT DATA

| Temperature Range | e(in./in./°F. × $10^{-6}$) |
|---|---|
| 70° F.–800° F. | 7.50 |
| 70° F.–1000° F. | 7.70 |
| 70° F.–1200° F. | 8.00 |
| 70° F.–1300° F. | 8.21 |

Notes:
*Test Article: 0.375" diameter × 2.0" long pins.
*Condition: Solutioned + 24% cold work + 1350° F./4 hours/AC.

Three separate stress-relaxation trials were conducted on bolts using the cylinder method described in MIL-STD-1312, test number 17. A review of the hardware utilized and the test results are presented in Table 21 below.

TABLE 21

CMBA-6 (Heat VF 790, Lot 1) STRESS-RELAXATION* DATA

| Original Stress ksi | Exposure Temp. °F. | Exposure Time hrs. | Relaxation joint, ksi | Relaxation bolt, ksi | % Relaxed | Remaining Stress ksi |
|---|---|---|---|---|---|---|
| a. Cylinder Material = MP210 Alloy Nut Material = SPS FN1418 (Waspaloy Silver plated, lock tapped out) | | | | | | |
| 190.3 | 1300 | 500 | 16.6 | 161.8 | 85.0 | 11.9 |
| 174.2 | 1300 | 500 | 14.8 | 147.9 | 84.8 | 11.5 |
| 72.9 | 1300 | 500 | 16.6 | 43.5 | 59.7 | 12.8 |
| b. Cylinder Material = MP210 Alloy Nut Material = SPS FN1418 (Waspaloy Silver plated, lock tapped out) | | | | | | |
| 138.0 | 1050 | 640 | 9.2 | 47.3 | 34.3 | 81.5 |
| c. Cylinder Material = MP210 Alloy Nut Material = GE J627P06B (Waspaloy unplated, lock in) | | | | | | |
| 85.0 | 1300 | 300 | 28.8 | 22.2 | 60.0 | 34.0 |

Notes:
Test Article: ⅜ – 24 spline-head bolts (threads rolled after aging).
Specimens solution + 24% cold worked + aged at 1350° F./4 hrs./AC.
*Stress based on area at the basic pitch diameter (0.09506 in.$^2$).

The second 2"×2" billet from Heat VF790 (Lot 2) was hot rolled at about 2050° F. to 0.447" diameter, solution treated at 2015° F. for 2 hours, cold drawn 24% to 0.390" diameter, and aged at 1350° F. for 4 hours. Standard 0.252" diameter specimens, notched specimens (notch tip radius machined to achieve $K_T$ of 3.5 and 6.0), and spline head bolts (⅜-24× 1.270) were fabricated and tested. Density was determined to be 0.311 lb./in.$^3$ by measuring .1; the weight and volume of a cylindrical sample. Tensile tests were conducted on the smooth and notched specimens per ASTM E8 and E21; the results are presented below in Tables 22 and 23, respectively.

TABLE 22

CMBA-6 (Heat VF 790, Lot 2) SMOOTH TENSILE DATA

| Test Temperature, °F. | UTS, ksi | 0.2% YS, ksi | E % | RA % |
|---|---|---|---|---|
| RT | 229.6 | 211.1 | 16.7 | 38.0 |
| 800 | 200.5 | 180.4 | 15.0 | 39.7 |
| 1000 | 193.9 | 178.9 | 14.7 | 41.5 |
| 1100 | 189.5 | 174.4 | 14.7 | 40.3 |
| 1200 | 187.0 | 168.9 | 14.0 | 42.9 |
| 1300 | 181.1 | 163.9 | 10.0 | 43.1 |
| 1400 | 167.1 | 153.0 | 7.7 | 16.0 |

Notes:
*Results presented are averaged values.
*Test Article: .252" diameter specimens.
*Condition: Solutioned + 24% cold work + 1350° F./4 hours/AC.

TABLE 23

CMBA-6 (Heat VF 790, Lot 2) NOTCHED TENSILE DATA

| Test Temperature | $K_T$ | NTS, ksi | NTS/UTS |
|---|---|---|---|
| RT | 3.5 | 350 | 1.52 |
| RT | 6.0 | 348 | 1.51 |

TABLE 23-continued

CMBA-6 (Heat VF 790, Lot 2) NOTCHED TENSILE DATA

| Test Temperature | $K_T$ | NTS, ksi | NTS/UTS |
|---|---|---|---|
| 1200° F. | 6.0 | 288 | 1.53 |
| 1300° F. | 6.0 | 255 | 1.41 |

Notes:
*Results presented are averaged values.
*Test Arttcle: D = .252" diameter; d = .177" diameter; r = variable to achieve given $K_T$.
*Condition: Solutioned + 24% cold work + 1350° F./4 hours/AC.

Tensile tests were performed on the bolts per MIL-STD-1312, test numbers 8 and 18. These test results are presented in Table 24 below.

TABLE 24

CMBA-6 (Heat VF 790, Lot 2) BOLT TENSILE DATA

| Test Temperature, °F. | UTS, ksi | YS, ksi |
|---|---|---|
| RT | 223 | 194 |
| 200 | 213 | 187 |
| 400 | 206 | 180 |
| 600 | 203 | 182 |
| 800 | 192 | 174 |
| 1000 | 189 | 173 |
| 1100 | 188 | 170 |
| 1200 | 185 | 169 |
| 1200 (2" wedge) | 183 | 162 |
| 1300 | 182 | 168 |
| 1400 | 170 | 155 |

Notes:
*Test Article: ⅜–24 × 1.270 spline head bolts.
*Condition: Solutioned + 24% cold work + 1350° F./4 hours/AC.
*Results presented are averaged values.
*Stress based on area at the basic pitch diameter (0.09506 in.$^2$).

Fatigue tests were run on the bolts per MIL-STD-1312, test number 11. The tests were conducted at room temperature (RT) with an R-ratio of 0.1 or 0.8, at 500° F. with an R-ratio of 0.6, and at 1300° F. with an R-ratio of 0.05. These test results are presented in Table 25 below.

TABLE 25

CMBA-6 BOLT FATIGUE DATA (Heat VF 790, Lot 2)

| Test Condition | Maximum Stress, ksi | Cycles to Failure |
|---|---|---|
| *Room Temperature | 160.4 | 79,000 |
| *R = 0.1 | 160.4 | 62,000 |
| | 160.4 | 70,000 |
| | 160.4 | 80,000 |
| | 160.4 | 53,000 |
| | 117.9 | 558,000 |
| | 117.9 | 478,000 |
| | 117.9 | 401,000 |
| | 117.9 | 398,000 |
| | 117.9 | 352,000 |
| | 100.0 | 986,000 |
| | 98.0 | 1,294,000 |
| | 96.0 | 1,206,000 |
| | 94.0 | 1,127,000 |
| | 90.0 | 2,562,000 |
| | 88.0 | 2,610,000 |
| | 86.0 | 1,916,000 |
| | 85.0 | 7,937,000 NF |
| | 84.0 | 3,187,000 |
| | 84.0 | 3,920,000 |
| | 84.0 | 4,788,000 |
| | 82.0 | 3,013,000 |

TABLE 25-continued

CMBA-6 BOLT FATIGUE DATA (Heat VF 790, Lot 2)

| Test Condition | Maximum Stress, ksi | Cycles to Failure |
|---|---|---|
| | 82.0 | 3,155,000 |
| | 82.0 | 7,027,000 |
| | 82.0 | 4,555,000 |
| | 82.0 | 5,708,000 |
| | 80.0 | 11,000,000 NF |
| | 80.0 | 8,617,000 |
| | 80.0 | 5,617,000 NF |
| *Room Temperature | 190 | 550,000 |
| *R = 0.8 | 190 | 221,000 |
| | 190 | 199,000 |
| | 190 | 175,000 |
| | 165 | 569,000 |
| | 165 | 473,000 |
| | 165 | 462,000 |
| | 165 | 442,000 |
| | 152 | 2,911,000 |
| | 148 | 2,500,000 |
| | 148 | 3,068,000 |
| | 148 | 1,790,000 |
| | 148 | 6,330,000 NF |
| | 145 | 39,000,000 NF |
| | 145 | 5,291,000 |
| | 145 | 5,000,000 NF |
| | 142 | 15,000,000 NF |
| | 139 | 14,217,000 NF |
| | 136 | 45,000,000 NF |
| | 133 | 15,744,000 NF |
| | 130 | 5,000,000 NF |
| | 130 | 2,356,000 |
| | 127 | 10,452.000 NF |
| *1300°F. | 110 | 2,826 |
| *R = 0.05 | 110 | 5,462 |
| | 110 | 1,636 |
| | 100 | 4,026 |
| | 100 | 5,739 |
| | 100 | 3,013 |
| | 90 | 16,174 |
| | 90 | 13,299 |
| | 90 | 85,560 NF |
| *500°F. | 160.0 | 138,000 |
| *R = 0.6 | 160.0 | 71,000 |
| | *160.0 | 57,000 |
| | *160.0 | 49,000 |

Notes:
*Test Article: ⅜–24 × 1.270 spline head bolts
*Specimen Condition: Solutioned + 24% cold work + 1350° F./4 hrs./AC
*Stress based on area at the basic pitch diameter (0.09506 in.$^2$).
*NF = No Failure.
*Bolts exposed to 1050° F./24 hrs. before fatigue testing.

Stress-rupture tests were performed on the bolts per MIL-STD-1312, test number 10. These test results are presented in Table 26 below.

TABLE 26

CMBA-6 (Heat VF 790, Lot 2) BOLT STRESS-RUPTURE DATA

| Test Conditions | Time to Failure, hours |
|---|---|
| 1100° F./175 ksi | 36.5 |
| 1200° F./150 ksi | 28.5 |
| 1200° F./135 ksi | 103.2 |
| 1250° F./112 ksi | 158.5 |
| 1300° F./100 ksi | 189.6 |
| 1300° F./120 ksi | 160.3 |

TABLE 26-continued

CMBA-6 (Heat VF 790, Lot 2) BOLT STRESS-RUPTURE DATA

| Test Conditions | Time to Failure, hours |
|---|---|
| 1300° F./125 ksi | 2.5 |
| 1400° F./60 ksi | 147.1 |

Notes:
*Test Article: ⅜–24 × 1.270 spline head bolts.
*Condition: Solutioned + 24% cold work + 1350° F./4 hours/AC.
*Results presented are averaged values.
*Stress based on area at the basic pitch diameter (0.09506 in.$^2$).

Thermal stability was evaluated using 1) bolts exposed to constant stress and temperature for 100 hours and 2) stress relaxation tested bolts, and comparing their subsequent tension-impact strength, 2° wedge tensile strength, and 4° wedge tensile strength to that of unexposed bolts. These test results are presented in Table 27 and Table 28 below.

TABLE 27

CMBA-6 (Heat VF 790, Lot 2)
BOLT THERMAL STABILITY - SUSTAINED LOAD EXPOSURE

| Bolt History | | | | Room Temperature Test Results | |
|---|---|---|---|---|---|
| Initial Stress ksi | Final Stress ksi | Temperature °F. | Time Hours | 2° Wedge Tensile Strength ksi | Tension-Impact Strength ft – lbs |
| No Exposure | | | | 227.7 | 238 |
| | | | | 226.3 | 233 |
| Sustained Load Exposure | | | | | |
| 125 | 125 | 1100 | 100 | 227.8 | 135 |
| | | | | 227.2 | 135 |
| 75 | 75 | 1200 | 100 | 228.2 | 127 |
| | | | | 226.6 | 124 |
| 62.5 | 62.5 | 1250 | 100 | 226.7 | 138 |
| | | | | 226.5 | 115 |
| 50 | 50 | 1300 | 100 | 218.1 | 136 |
| | | | | 215.9 | 128 |

Notes:
Test Article: ⅜ – 24 × 1.270 spline head bolts.
Condition: Solutioned + 24% cold work + 1350° F./4 hours/AC.
Stress based on area at the basic pitch diameter (0.09506 in.$^2$).

TABLE 28

CMBA-6 (Heat VF 790, Lot 2)
BOLT THERMAL STABILITY - STRESS-RELAXATION EXPOSURE

| Bolt History | | | | Room Temperature Test Results | | |
|---|---|---|---|---|---|---|
| Initial Stress ksi | Final Stress ksi | Temperature °F. | Time Hours | 2° Wedge Tensile Strength ksi | 4° Wedge Tensile Strength ksi | Tension-Impact Strength ft – lbs |
| No Exposure | | | | 227.7 | | 238 |
| | | | | 226.3 | | 233 |
| Stress-Relaxation Exposure | | | | | | |
| 125.1 | 84.4 | 1200 | 100 | | | 155 |
| 98.9 | 78.5 | | 100 | | 200.4 | |
| 116.3 | 75.6 | 1200 | 500 | | | 114 |
| 104.7 | 72.7 | | 500 | | 221.1 | |
| 116.3 | 69.8 | 1200 | 1000 | | | 121 |
| 107.6 | 66.9 | | 1000 | | 187.6 | |

TABLE 28-continued

CMBA-6 (Heat VF 790, Lot 2)
BOLT THERMAL STABILITY - STRESS-RELAXATION EXPOSURE

| Bolt History | | | | Room Temperature Test Results | | |
|---|---|---|---|---|---|---|
| | | | | 2° Wedge | 4° Wedge | Tension- |
| Initial Stress ksi | Final Stress ksi | Temperature °F. | Time Hours | Tensile Strength ksi | Tensile Strength ksi | Impact Strength ft – lbs |
| 84.3 | 49.8 | 1300 | 100 | | | 144 |
| 78.5 | 52.4 | | 100 | | 217.5 | |
| 84.4 | 37.8 | 1300 | 250 | | | 112 |
| 81.4 | 37.8 | 1300 | 500 | 209.5 | 186.8 | |
| 84.3 | 32.0 | | 500 | | | |
| 81.4 | 29.1 | | 500 | | | 92 |
| 138.0 | 81.5 | 1050 | 640 | | | 121 |
| 190.3 | 28.5 | 1300 | 500 | | 204.5 | |
| 174.2 | 26.3 | | 500 | 201.5 | | |
| 72.9 | 29.4 | | 500 | | | 91 |

Notes:
Test Article: ⅜ – 24 × 1.270 spline head bolts.
Condition: Solutioned + 24% cold work + 1350° F./4 hours/AC.
Stress based on area at the basic pitch diameter (0.09506 in.$^2$).

Another stress-relaxation trial was conducted on bolts using the cylinder method described in MIL-STD-1312, test number 17. A review of the hardware utilized and the test results are presented in Table 29 below.

TABLE 29

CMBA-6 (Heat VF 790, Lot 2) STRESS-RELAXATION* DATA

| Original Stress ksi | Exposure Temp. °F. | Exposure Time hrs. | Relaxation joint, ksi | Relaxation bolt, ksi | % Relaxed | Remaining Stress ksi |
|---|---|---|---|---|---|---|
| Cylinder Material = Waspaloy<br>Nut Material = SPS FN1418 (Waspaloy Silver plated, lock tapped out) | | | | | | |
| 125.1 | 1200 | 100 | 17.5 | 23.2 | 32.6 | 84.4 |
| 98.9 | 1200 | 100 | 11.6 | 8.7 | 20.6 | 78.6 |
| 116.3 | 1200 | 500 | 17.5 | 23.3 | 35.0 | 75.5 |
| 104.7 | 1200 | 500 | 20.4 | 11.6 | 30.6 | 72.7 |
| 116.3 | 1200 | 1000 | 17.5 | 29.1 | 40.0 | 69.7 |
| 107.6 | 1200 | 1000 | 14.5 | 26.1 | 37.8 | 67.0 |
| 84.3 | 1300 | 100 | 26.2 | 8.7 | 41.4 | 49.4 |
| 78.5 | 1300 | 100 | 26.2 | 0.0 | 33.3 | 52.3 |
| 84.4 | 1300 | 250 | 32.0 | 14.5 | 55.2 | 37.9 |
| 81.4 | 1300 | 500 | 29.1 | 14.5 | 53.6 | 37.8 |
| 84.3 | 1300 | 500 | 34.9 | 17.5 | 62.1 | 31.9 |
| 81.4 | 1300 | 500 | 43.6 | 8.7 | 64.3 | 29.1 |

Notes:
Test Article: ⅜ – 24 spline-head bolts (threads rolled after aging).
Specimens solutioned + 24% cold worked + aged at 1350° F./4 hrs./AC.
*Stress based on area at the basic pitch diameter (0.09506 in.$^2$).

EXAMPLE5

A 1500 pound heat (VV 584) of CMBA-6 was VIM-processed to 9½" diameter, ESR-processed to 14½" diameter, homogenize-annealed at 2125° F./4 hours+2150° F./65 hours, and hot forged at about 2050° F. to 4¼" diameter. Some of the material was divided into seven lots and processed to 0.395" diameter bar as described below in Table 30:

TABLE 30

CMBA-6 (Heat VV 584) PROCESSING CONDITIONS

| Lot # | Not Rolled at 2050° F. to: | Solution Treat Cycle | Cold Draw Percent |
|---|---|---|---|
| 1 | .453" | 1965° F./1 hr | 24 |
| 2 | .466" | 1965° F./1 hr | 28 |
| 3 | .479" | 1965° F./1 hr | 32 |
| 4 | .453" | 2000° F./2 hrs | 24 |
| 5 | .466" | 2000° F./2 hrs | 28 |
| 6 | .479" | 2000° F./2 hrs | 32 |
| 7 | .453" | 2000° F./2 hrs | 24 |

Notes:
*Lots 1 through 6 drawn in 3 passes.
*Lot 7 drawn in pass.

All seven sublots were given a final age at 1350° F. for 4 hours/AC.

Standard 0.252" diameter specimens were fabricated from each sublot and tensile tested per ASTM E8 and E21. Table 31, presented below, shows the results of the tensile tests undertaken with CMBA-6 material, which was processed as described above in Table 30, and tested at room temperature (RT), 800° F., 1000° F., 1200° F. and 1400° F.

TABLE 31

CMBA-6 (HEAT VV 584) SMOOTH TENSILE PROPERTIES

| Test Temp. °F. | Lot No. 1 | 2 | 3 | 4 | 5 | 6 | 7 |
|---|---|---|---|---|---|---|---|
| RT | | | | | | | |
| UTS, ksi | 277.6 | 280.4 | 299.0 | 234.0 | 240.0 | 255.4 | 239.5 |
| 0.2% YS | 267.7 | 273.7 | 294.0 | 215.8 | 225.6 | 239.1 | 224.5 |
| Elong. % | 9.0 | 8.0 | 6.0 | 9.0 | 10.0 | 8.0 | 8.0 |
| RA % | 30.9 | 30.0 | 27.6 | 34.2 | 34.5 | 32.3 | 31.9 |
| 800 | | | | | | | |
| UTS, ksi | 243.6 | 252.3 | 263.1 | 211.1 | 210.0 | 225.0 | 208.3 |
| 0.2% YS | 234.6 | 248.1 | 254.1 | 203.0 | 200.8 | 218.0 | 195.5 |
| Elong. % | 10.0 | 8.0 | 5.5 | 8.5 | 10.0 | 8.0 | 11.0 |
| RA % | 31.8 | 27.6 | 26.5 | 33.5 | 34.5 | 32.5 | 33.2 |
| 1000 | | | | | | | |
| UTS, ksi | 237.2 | 250.0 | 256.3 | 201.8 | 204.3 | 214.8 | 201.4 |
| 0.2% YS | 227.8 | 245.9 | 251.9 | 193.2 | 193.1 | 206.0 | 191.0 |
| Elong. % | 10.0 | 8.0 | 5.0 | 9.0 | 10.0 | 8.0 | 11.0 |
| RA % | 31.6 | 27.9 | 25.2 | 34.2 | 33.8 | 35.8 | 35.1 |
| 1200 | | | | | | | |
| UTS, ksi | 231.9 | 255.5 | 249.4 | 196.3 | 199.7 | 208.5 | 196.9 |
| 0.2% YS | 218.8 | 250.6 | 238.3 | 184.0 | 186.5 | 198.5 | 186.5 |
| Elong. % | 10.0 | 5.5 | 5.0 | 8.0 | 10.0 | 8.0 | 10.5 |
| RA % | 34.4 | 13.0 | 22.4 | 33.5 | 31.2 | 33.1 | 33.5 |
| 1400 | | | | | | | |
| UTS, ksi | 224.4 | 220.6 | 237.0 | 183.1 | 193.6 | 166.7 | 188.7 |
| 0.2% YS | 206.0 | 203.0 | 220.3 | 174.6 | 182.7 | 161.6 | 181.1 |
| Elong. % | 9.5 | 6.0 | 8.0 | 8.0 | 10.0 | — | 6.0 |
| RA % | 20.3 | 13.0 | 41.4 | 33.2 | 30.8 | — | 31.2 |

Note:
Results presented are averaged values.
Test Article: .252" diameter specimens
Condition: See Table 30 + 1350° F./4 hours/AC In addition to the 0.395" diameter bar described above, Heat VV 584 was used to make 0.535" and 0.770" diameter bars. They were produced by rolling the hot forged stock at about 2050° F. to about 0.614" and 0.883" diameters, respectively, solution treating at 2000° F./2 hours/AC, and cold drawing 24% to the desired 0.535" and 0.770" dimensions. The bars were given a final age at 1350° F. for 4 hours/AC. Various tests were conducted utilizing these materials as described below.

Double shear tests were performed on cylindrical blanks per MIL-STD-1312, test number 13. These test results are presented in Table 32 below.

TABLE 32

CMBA-6 (Heat VV 584)
DOUBLE SHEAR STRENGTH DATA

| Test Diameter, in. | ksi* |
|---|---|
| .375 (Lot 4) | 147.6 |
| | 147.6 |
| .500 | 141.1 |
| | 139.8 |
| .750 | 147.1 |
| | 146.0 |

Note:
*Stress is based on twice the body diameter area =
0.2209 in.$^2$ for .375
0.3927 in.$^2$ for .500
0.88358 in.$^2$ for .750

Thermal conductivity measurements were performed on a right cylinder specimen, 1.000" diameter by 1.000" long per ASTM E1225. There were three thermocouple holes in the specimen, and the test temperature ranged from −320° F. to 1300° F. The test results are presented in Table 33 below.

TABLE 33

CMBA-6 (Heat VV 584)
THERMAL CONDUCTIVITY DATA

| Temperature °F. | Thermal Conductivity STU-in/hr-ft$^2$-°F. |
|---|---|
| −303 | 60.66 |
| −159 | 63.78 |
| 0 | 69.68 |
| 221 | 78.27 |
| 383 | 87.29 |
| 565 | 96.09 |
| 747 | 106.21 |
| 919 | 121.19 |
| 1096 | 132.28 |
| 1274 | 143.51 |

Electrical resistivity measurements were performed using the Form Point Probe Method on a 3.00" long by 0.250" square specimen per ASTM B193. The test temperature ranged from −320° F. to 1300° F. The test results are presented in Table 34 below.

TABLE 34

CMBA-6 (Neat VV 584)
ELECTRICAL RESISTIVITY DATA

| Temperature °F. | Electrical Resistivity ohm-in × $10^6$ |
|---|---|
| −303 | 44.22 |
| −261 | 44.36 |
| −222 | 44.64 |
| −184 | 44.91 |
| −67 | 45.47 |
| −8 | 46.02 |
| 73 | 46.28 |
| 198 | 46.55 |

TABLE 34-continued

CMBA-6 (Neat VV 584)
ELECTRICAL RESISTIVITY DATA

| Temperature °F. | Electrical Resistivity ohm-in × $10^6$ |
|---|---|
| 397 | 47.39 |
| 595 | 48.17 |
| 802 | 49.74 |
| 1009 | 50.86 |
| 1202 | 51.67 |
| 1296 | 52.74 |

Specific heat measurements were performed using the Bunsen Ice Calorimeter Technique on a 1.5" long by 0.25" inch square specimen per ASTM D2766. The test temperature ranged from 70° F. to 1300° F. The test results are presented in Table 35 below.

TABLE 35

CMBA-6 (Heat VV 584)
ENTHALPY/SPECIFIC HEAT DATA

| Temperature °F. | Enthalpy, STU/lb. | Temperature °F. | Specific Heat STU/lb.-°F. |
|---|---|---|---|
| 32 | 0 | 32 | 0.099 |
| 122 | 10.440 | 122 | 0.104 |
| 311 | 32.224 | 212 | 0.108 |
| 532 | 58.304 | 302 | 0.112 |
| 747 | 83.612 | 392 | 0.116 |
| 1036 | 119.075 | 482 | 0.119 |
| 1303 | 152.500 | 572 | 0.122 |
| | | 662 | 0.124 |
| | | 842 | 0.125 |
| | | 932 | 0.125 |
| | | 1022 | 0.126 |
| | | 1112 | 0.127 |
| | | 1292 | 0.130 |

Young's modulus, shear modulus and Poisson's ratio were determined by performing dynamic modulus measurements on a 0.500" diameter by 2.000" long specimen per ASTM E494. The test temperature ranged from 70° F. to 1300° F. The results are presented in Table 36 below.

TABLE 36

CMBA-6 (Heat VV 584)
DYNAMIC MODULUS DATA

| Temperature °F. | $v_l$ km/s | $v_t$ km/s | Elastic Modulus Msi | Shear Modulus Msi | Poisson's Ratio |
|---|---|---|---|---|---|
| 72 | 5.73 | 3.13 | 31.3 | 12.2 | 0.287 |
| 437 | 5.64 | 3.05 | 29.8 | 11.5 | 0.293 |
| 613 | 5.57 | 2.93 | 27.9 | 10.7 | 0.309 |
| 892 | 5.47 | 2.88 | 26.9 | 10.3 | 0.309 |
| 1011 | 5.32 | 2.80 | 25.4 | 9.72 | 0.308 |
| 1359 | 5.19 | 2.58 | 22.1 | 8.25 | 0.336 |

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

What is claimed is:

1. A nickel-cobalt based alloy consisting essentially of the following elements in percent by weight:

| | |
|---|---|
| Carbon | about 0.002–0.07 |
| Boron | about 0–0.04 |
| Columbium | about 0–2.5 |
| Chromium | about 12–19 |
| Molybdenum | about 0–6 |
| Cobalt | about 20–35 |
| Aluminum | about 0.9–1.5 |
| Titanium | about 0–5 |
| Tantalum | about 3.8–5.0 |
| Tungsten | about 0–6 |
| Vanadium | about 0–2.5 |
| Zirconium | about 0–0.06 |
| Nickel + Incidental Impurities | Balance |

said alloy having a phasial stability number $N_{v3B}$ less than about 2.60.

2. The alloy of claim 1 further comprising the following elements in percent by weight:

| | |
|---|---|
| Silicon | about 0–0.15 |
| Manganese | about 0–0.15 |
| Iron | about 0–2.0 |
| Copper | about 0–0.1 |
| Phosphorus | about 0–0.015 |
| Sulfur | about 0–0.015 |
| Nitrogen | about 0–0.02 |
| Oxygen | about 0–0.01 |

3. The alloy of claim 1 wherein said alloy has a platelet phase and a gamma prime phase dispersed in a face-centered cubic matrix.

4. The alloy of claim 1 wherein said alloy is substantially free of embrittling phases.

5. The alloy of claim 1 wherein said alloy has been worked to achieve a reduction in cross-section of at least 5%.

6. The alloy of claim 1 wherein said alloy has been aged after cold working.

7. The alloy of claim 1 wherein said alloy has been aged, cold worked to achieve a reduction in cross-section of at least 5% and then aged again.

8. An article made from the alloy of claim 1.

9. The article of claim 8 wherein said article is a bar, billet, sheet, forging or casting.

10. A fastener made from an alloy consisting essentially of the following elements in percent by weight:

| | |
|---|---|
| Carbon | about 0.002–0.07 |
| Boron | about 0–0.04 |
| Columbium | about 0–2.5 |
| Chromium | about 12–19 |
| Molybdenum | about 0–6 |
| Cobalt | about 20–35 |
| Aluminum | about 0.9–1.5 |
| Titanium | about 0–5 |
| Tantalum | about 3.8–5.0 |
| Tungsten | about 0–6 |
| Vanadium | about 0–2.5 |
| Zirconium | about 0–0.06 |
| Nickel + Incidental Impurities | Balance |

said alloy having a phasial stability number $N_{v3B}$ less than about 2.60.

11. The fastener of claim 10 wherein said alloy further comprises the following elements in percent by weight:

| | |
|---|---|
| Silicon | about 0–0.15 |
| Manganese | about 0–0.15 |
| Iron | about 0–2.0 |
| Copper | about 0–0.1 |
| Phosphorus | about 0–0.015 |
| Sulfur | about 0–0.015 |
| Nitrogen | about 0–0.02 |
| Oxygen | about 0–0.01. |

12. The fastener of claim 10 wherein said alloy has a platelet phase and a gamma prime phase dispersed in a face-centered cubic matrix.

13. The fastener of claim 10 wherein said alloy is substantially free of embrittling phases.

14. The fastener of claim 10 wherein said alloy has been worked to achieve a reduction in cross-section of at least 5%.

15. The fastener of claim 10 wherein said alloy has been aged after cold working.

16. The fastener of claim 10 wherein said alloy has been aged, cold worked to achieve a reduction in cross-section of at least 5%, and then aged again.

17. The fastener of claim 10 wherein said fastener is a bolt, screw, nut, rivet, pin or collar.

* * * * *